US007794079B2

(12) United States Patent
Von Essen et al.

(10) Patent No.: US 7,794,079 B2
(45) Date of Patent: Sep. 14, 2010

(54) ADJUSTABLE MOUNT PRINTHEAD ASSEMBLY

(75) Inventors: Kevin Von Essen, San Jose, CA (US); John A. Higginson, Santa Clara, CA (US); Andreas Bibl, Los Altos, CA (US); Deane A. Gardner, Cupertino, CA (US); Micheal Rocchio, Hayward, CA (US); Stephen R. Deming, San Jose, CA (US); Daniel Alan West, Monte Sereno, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 12/411,196

(22) Filed: Mar. 25, 2009

(65) Prior Publication Data

US 2009/0201341 A1 Aug. 13, 2009

Related U.S. Application Data

(63) Continuation of application No. 11/961,958, filed on Dec. 20, 2007, now abandoned.

(60) Provisional application No. 60/871,701, filed on Dec. 22, 2006.

(51) Int. Cl.
*B41J 29/13* (2006.01)

(52) U.S. Cl. ..... 347/108

(58) Field of Classification Search ..... 347/108, 347/40, 43, 85
See application file for complete search history.

(56) References Cited

U.S. PATENT DOCUMENTS

| | | | | |
|---|---|---|---|---|
| 5,771,050 | A | 6/1998 | Gielen | |
| 6,089,693 | A | 7/2000 | Drake et al. | |
| 6,554,398 | B2 | 4/2003 | Wyngaert et al. | |
| 6,779,880 | B1 * | 8/2004 | Kulpa et al. | 347/86 |
| 7,216,970 | B2 * | 5/2007 | Costanza et al. | 347/108 |
| 2003/0227517 | A1 | 12/2003 | Yaron | |

FOREIGN PATENT DOCUMENTS

| | | |
|---|---|---|
| EP | 0 693 382 | 1/1996 |
| EP | 1 854 635 | 1/2007 |
| KR | 10-2006-098035 | 9/2006 |
| KR | 10-2007-074141 | 12/2007 |

OTHER PUBLICATIONS

International Search Report for PCT/US2007/088458, mailed Apr. 21, 2008.
Supplementary European Search Report for Application No. EP 07 86 5940, dated Feb. 26, 2010, 5 pages.

* cited by examiner

*Primary Examiner*—Lamson D Nguyen
(74) *Attorney, Agent, or Firm*—Fish & Richardson P.C.

(57) ABSTRACT

A mounting assembly for a printhead assembly is described that can allow dynamic nozzle and drop placement adjustment in one or more directions.

21 Claims, 20 Drawing Sheets

ADJUSTABLE MOUNT PRINTHEAD ASSEMBLY

CROSS-REFERENCE TO RELATED APPLICATIONS

This application is a continuation of U.S. patent application Ser. No. 11/961,958, filed on Dec. 20, 2007, which claims priority to U.S. Provisional Application Ser. No. 60/871,701, filed on Dec. 22, 2006, the entire contents of which are hereby incorporated by reference.

TECHNICAL FIELD

The following description relates to a method and apparatus for depositing fluid onto a substrate.

BACKGROUND

A fluid deposition device, for example, an ink jet printer typically includes an ink path from an ink supply to an ink nozzle assembly that includes nozzles from which ink drops are ejected. Ink is just one example of a fluid that can be ejected from a jet printer. Ink drop ejection can be controlled by pressurizing ink in the ink path with an actuator, for example, a piezoelectric deflector, a thermal bubble jet generator, or an electrostatically deflected element. A typical printhead has a line of nozzles with a corresponding array of ink paths and associated actuators, and drop ejection from each nozzle can be independently controlled. In a so-called "drop-on-demand" printhead, each actuator is fired to selectively eject a drop at a specific location on a substrate. The printhead and the substrate can be moving relative one another during a printing operation.

A printhead can include a semiconductor printhead body and a piezoelectric actuator. The printhead body can be made of silicon etched to define pumping chambers. Nozzles can be defined by a separate nozzle plate that is attached to the silicon body. The piezoelectric actuator can have a layer of piezoelectric material that changes geometry or flexs, in response to an applied voltage. Flexing of the piezoelectric layer pressurizes ink in a pumping chamber located along the ink path.

Printing accuracy can be influenced by a number of factors. Precisely positioning the nozzles relative to the substrate can be necessary for precision printing. If multiple printheads are used to print contemporaneously, then precise alignment of the nozzles included in the printheads relative to one another also can be critical for precision printing.

SUMMARY

Apparatus and methods for depositing a fluid onto a substrate are described. In general, a mounting assembly for a printhead that can allow dynamic nozzle and drop placement adjustment in one or more directions is provided.

In general, in one aspect, the invention features a mounting assembly for a printhead assembly including at least one mounting connector and an active first direction mount. The mounting connector is configured to connect the mounting assembly to the printhead assembly. The printhead assembly has a length in a first direction and a width in a second direction and the length is greater than the width. The active first direction mount includes a top component, a bottom component and two side components substantially forming a parallelogram configuration. The bottom component is fixed from movement and the top component is configured to move in the first direction while remaining substantially parallel to the bottom component. The two side components are configured to move in the first direction while remaining substantially parallel to one another. A first drive mechanism is configured to drive the top and two side components to move in the first direction. The mounting connector moves in the first direction in response to movement in the first direction of the two side and top components of the active first direction mount, thereby providing movement in the first direction to the printhead assembly.

Implementations of the invention can include one or more of the following features. The mounting assembly can further include at least a second mounting connector configured to connect the mounting assembly to the printhead assembly and a passive mount. The passive mount is configured to connect to the printhead assembly by the second mounting connector. The passive mount includes a top component, a bottom component and two side components substantially forming a parallelogram configuration. The bottom component is fixed from movement and the top component is configured to move in the first direction while remaining substantially parallel to the bottom component. The two side components are configured to move in the first direction while remaining substantially parallel to one another. The passive mount moves in the first direction in response to movement in the first direction of the printhead assembly connected to the passive mount by the second mounting connector.

The active first direction mount can further include a tongue protruding from the top component. The first drive mechanism is configured to directly drive movement of the tongue and thereby the top component in the first direction. In response to movement of the top component, which is flexibly connected to the two side components, the two side components are indirectly driven to move in the first direction.

The first drive mechanism can further include a motor configured to rotate a drive shaft about a first axis orientated in a third direction substantially perpendicular to the first and second directions. A bearing in contact with the tongue can be configured to rotate with an upper portion of the drive shaft, wherein the upper portion of the drive shaft has a center, longitudinal axis orientated in the third direction but displaced in the first direction from the first axis, the bearing thereby rotating eccentrically about the first axis. As the bearing rotates eccentrically about the first axis, the tongue and thereby the top component can be displaced in the first direction.

The mounting assembly can further include an active second direction mount configured to connect to the printhead assembly by the mounting connector. The active second direction mount can include an upper structure and a lower structure. The upper structure can include the mounting connector to connect to a printhead assembly and a second motor configured to rotate a drive shaft and an upper bearing about an axis of rotation. The upper structure can be connected to the active first direction mount by one or more flexures. The lower structure can be rigidly connected to the active first direction mount and can include a lower bearing connected to a lower portion of the drive shaft. The lower portion of the drive shaft can have a center, longitudinal axis orientated in the third direction but displaced in a perpendicular direction from the axis of rotation. The lower bearing can thereby rotate eccentrically relative to rotation of the upper bearing. The relative eccentric rotation of the lower and upper bearings can cause the upper structure to displace in the second direction as the lower and upper bearings rotate and thereby provide a pivot motion to the printhead assembly about an axis in a third direction.

In general, in another aspect, the invention features a system for depositing a fluid onto a substrate including a mounting assembly for a printhead assembly and the printing assembly. The mounting assembly includes at least one mounting connector configured to connect the mounting assembly to the printhead assembly. The printhead assembly has a length in a first direction and a width in a second direction and the length is greater than the width. The mounting assembly further includes an active first direction mount. The active first direction mount includes a top component, a bottom component and two side components substantially forming a parallelogram configuration. The bottom component is fixed from movement and the top component is configured to move in the first direction while remaining substantially parallel to the bottom component. The two side components are configured to move in the first direction while remaining substantially parallel to one another. A first drive mechanism is configured to drive the top and two side components to move in the first direction. The mounting connector moves in the first direction in response to movement in the first direction of the two side and top components of the active first direction mount. The printhead assembly includes a housing, nozzle assembly and printhead mounting connector. The housing is configured to house the nozzle assembly and includes a conduit configured to receive a printing fluid and provide the printing fluid to the nozzle assembly. The nozzle assembly includes multiple nozzles configured to receive the printing fluid and deposit the printing fluid onto a substrate. The printhead mounting connector is configured to mate with the mounting connector included in the mounting assembly. Movement in the first direction of the mounting connector mated to the printhead mounting connector provides movement to the printhead assembly in the first direction.

Implementations of the invention can include one or more of the following features. The mounting assembly can further include at least a second mounting connector configured to connect the mounting assembly to the printhead assembly and a passive mount. The passive mount can be configured to connect to the printhead assembly by the second mounting connector. The passive mount can include a top component, a bottom component and two side components substantially forming a parallelogram configuration, where the bottom component is fixed from movement and the top component is configured to move in the first direction while remaining substantially parallel to the bottom component. The two side components can be configured to move in the first direction while remaining substantially parallel to one another. The passive mount can move in the first direction in response to movement in the first direction of the printhead assembly connected to the passive mount by the second mounting connector.

The active first direction mount of the mounting assembly can further include a tongue protruding from the top component. The first drive mechanism can be configured to directly drive movement of the tongue and thereby the top component in the first direction. In response to movement of the top component, which is flexibly connected to the two side components, the two side components are indirectly driven to move in the first direction.

The first drive mechanism of the active first direction mount of the mounting assembly can include a motor configured to rotate a drive shaft about a first axis orientated in a third direction substantially perpendicular to the first and second directions, and a bearing in contact with the tongue. The bearing can be configured to rotate with an upper portion of the drive shaft, wherein the upper portion of the drive shaft has a center, longitudinal axis orientated in the third direction, but displaced in the first direction from the first axis, the bearing thereby rotating eccentrically about the first axis. As the bearing rotates eccentrically about the first axis, the tongue and thereby the top component can be displaced in the first direction.

The mounting assembly can further include an active second direction mount configured to connect to the printhead assembly by the one mounting connector. The active second direction mount can include an upper structure and a lower structure. The upper structure can include the mounting connector to connect to a printhead assembly and a second motor configured to rotate a drive shaft and an upper bearing about an axis of rotation. The upper structure can be connected to the active first direction mount by one or more flexures. The lower structure can be rigidly connected to the active first direction mount. The lower structure can include a lower bearing connected to a lower portion of the drive shaft. The lower portion of the drive shaft can have a center, longitudinal axis orientated in the third direction but displaced in a perpendicular direction from the axis of rotation. The lower bearing can thereby rotate eccentrically relative to rotation of the upper bearing. The relative eccentric rotation of the lower and upper bearings can cause the upper structure to displace in the second direction as the lower and upper bearings rotate and thereby provide a pivot motion to the printhead assembly about an axis in a third direction.

The printhead mounting connector configured to mate with the mounting connector included in the mounting assembly can be a mounting plate attached to the housing and including a first portion extending from a first side of the housing and a second portion extending from a second side of the housing. The mounting connector included in the mounting assembly can include a first slot in the active second direction mount configured to receive the first extended portion of the mounting plate, a first channel in the active second direction mount and one or more first elements adjacent the first channel. The mounting connector can further include a first mounting plate clamp screw slidably received in the first channel, such that the one or more first elements are urged against the first extended portion of the mounting plate when the first mounting plate clamp screw is screwed into the first channel. The second mounting connector included in the mounting assembly can include a second slot included in the passive mount configured to receive the second extended portion of the mounting plate, a second channel included in the passive mount and one or more second elements adjacent the second channel. The second mounting connector can further include a second mounting plate clamp screw slidably received in the second channel, such that the one or more second elements are urged against the second extended portion of the mounting plate when the second mounting plate clamp screw is screwed into the second channel.

The printhead assembly can further include a gas conduit configured to receive a gas at a temperature lower than a temperature of the fluid within the nozzle assembly and to provide the gas to a region near the nozzle assembly. In one example, the gas is substantially dry air. The housing of the printhead assembly can further include a gas outlet configured to expel the gas after passing through the region near the nozzle assembly. The nozzle assembly of the printhead assembly can further include fluid inlets and pumping chambers. Each fluid inlet can be fluidly coupled to a pumping chamber, which is fluidly coupled to a nozzle. In response to a control signal activating an actuator adjacent the pumping chamber, printing fluid can be urged from the pumping chamber through the nozzle and onto the substrate. The printhead assembly can further include a circuit system configured to receive input signals and, based on the received input signals, provide control signals to the nozzle assembly to selectively fire the plurality of nozzles. The actuator can include a piezoelectric deflector configured to flex in response to the control signal, the flex displacing printing fluid included in the pumping chamber.

In general, in another aspect, the invention features a printhead assembly for depositing a fluid onto a substrate. The printhead assembly includes a housing including a fluid conduit, a gas conduit and a nozzle assembly. The fluid conduit is configured to receive the fluid from a fluid source and to provide the fluid to the nozzle assembly. The gas conduit is configured to receive a gas at a temperature lower than a temperature of the fluid within the nozzle assembly and to provide the gas to a region near the nozzle assembly. The nozzle assembly is mounted within the housing and includes fluid inlets, pumping chambers and nozzles. Each fluid inlet is fluidly coupled to a pumping chamber, which is fluidly coupled to a nozzle. In response to a control signal activating an actuator adjacent the pumping chamber, fluid is urged from the pumping chamber through the nozzle and onto the substrate. The printhead assembly further includes a circuit system configured to receive input signals and based on the received input signals provide control signals to the nozzle assembly to selectively fire the plurality of nozzles.

Implementations of the invention can include one or more of the following features. The gas can be substantially dry air. The housing can further include a gas outlet configured to expel the gas after passing through the region near the nozzle assembly. The actuator can include a piezoelectric deflector configured to flex in response to the control signal, the flex displacing fluid included in the pumping chamber. A mounting plate can be attached to the housing and including portions extending from a first and a second side of the housing. The extended portions can be configured to mate with a mounting assembly.

Implementations of the invention can realize one or more of the following advantages. Nozzles included in a printhead assembly can be precisely positioned relative to a substrate upon which fluid ejected from the nozzles will be deposited and relative to nozzles included in neighboring printhead assemblies. The precision with which the position of the nozzles can be adjusted, in one implementation, is within approximately ½ a micron.

The mounting assembly is configured so as to allow dynamic alignment corrections to be made while the printhead assembly is active. For example, by sensing at least one of the substrate position (i.e., the substrate upon which fluid is being deposited), the drop ejection location or the nozzle locations, the information so gathered can be used to actively correct the alignment of the nozzles. Advantageously, misalignment that occurs due to operating conditions can be corrected during operation. For example, if misalignment occurs due to thermal changes in the printhead assembly during operation (e.g., thermal growth), realignment can occur without interrupting a fluid deposition operation.

Gas can be used to control the temperature in the region of the printhead alone or in conjunction with one or more heaters, allowing for dynamic temperature adjustment.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A printhead assembly and a mounting assembly for the printhead assembly are described. An exemplary fluid deposited by the printhead assembly is ink. However, it should be understood that other fluids can be used, for example, electroluminescent material used in the manufacture of light emitting displays, liquid metals used in circuit board fabrication or biological fluid.

The mounting assembly includes at least one mounting connector configured to connect the mounting assembly to the printhead assembly. The printhead assembly has a length in a first direction and a width in a second direction, where the length is greater than the width. The mounting assembly further includes an active first direction mount.

The active first direction mount includes a top component, a bottom component and two side components substantially forming a parallelogram configuration. The bottom component is fixed from movement and the top component is configured to move in the first direction, while remaining substantially parallel to the bottom component. The two side components are configured to move in the first direction while remaining substantially parallel to one another. A first drive mechanism is configured to drive the top component to move in the first direction. The two side components move in the first direction in response to movement of the top component. The mounting connector moves in the first direction in response to movement in the first direction of the two side and top components of the active first direction mount, thereby providing movement in the first direction to the printhead assembly to which it is connected.

Figure 1A:
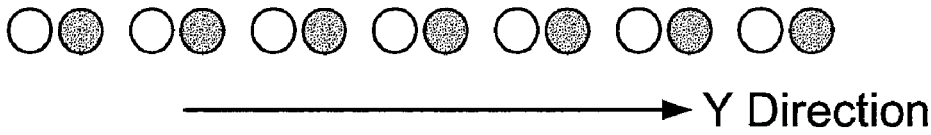
FIG. 1A is a schematic representation of dot placement adjustment in a y direction.
Figure 1B:
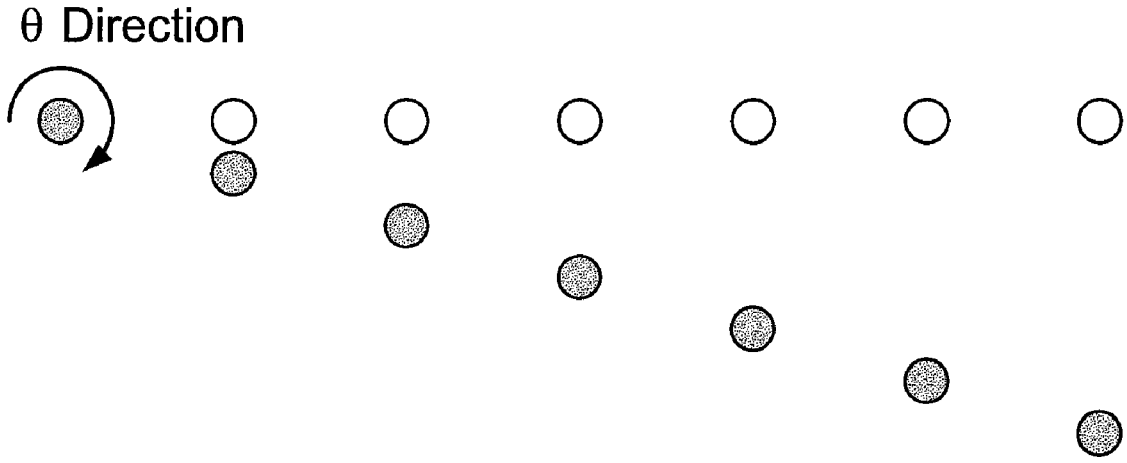
FIG. 1B is a schematic representation of dot placement adjustment in a θ direction.
Figure 1C:
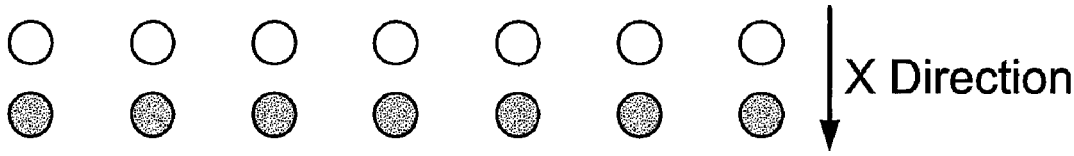
FIG. 1C is a schematic representation of dot placement adjustment in an x direction.

Referring to FIG. 1A, in one implementation, the active first direction mount is configured to adjust the position of the nozzles included in the printhead assembly, and therefore the corresponding fluid drop placement, in the y direction as shown. Referring to FIG. 1B, in one implementation, an active second direction mount is configured to adjust the position of the nozzles, and therefore the corresponding fluid drop placement, in the θ direction as shown. Referring to FIG. 1C, in one implementation, where the nozzles are moving relative to a substrate upon which fluid is being deposited in the x direction, the position of the nozzles and therefore the corresponding fluid drop placement in the x direction, as shown, can be controlled by adjusting the printhead fire pulse timing.

The mounting assembly is configured so as to allow dynamic alignment corrections to be made while the printhead assembly is active. For example, by sensing at least one of the substrate position (i.e., the substrate upon which is fluid is being deposited), the drop placement location or the nozzle locations, the information so gathered can be used to actively correct the alignment of the nozzles. For example, if misalignment occurs due to thermal changes in the printhead assembly (e.g., thermal growth), realignment can occur without interrupting a fluid deposition operation. In one implementation, drop placement is monitored and controlled with a closed loop servo, that is, the drop placement is adjusted dynamically while a fluid deposition process is underway.

Figure 2A:
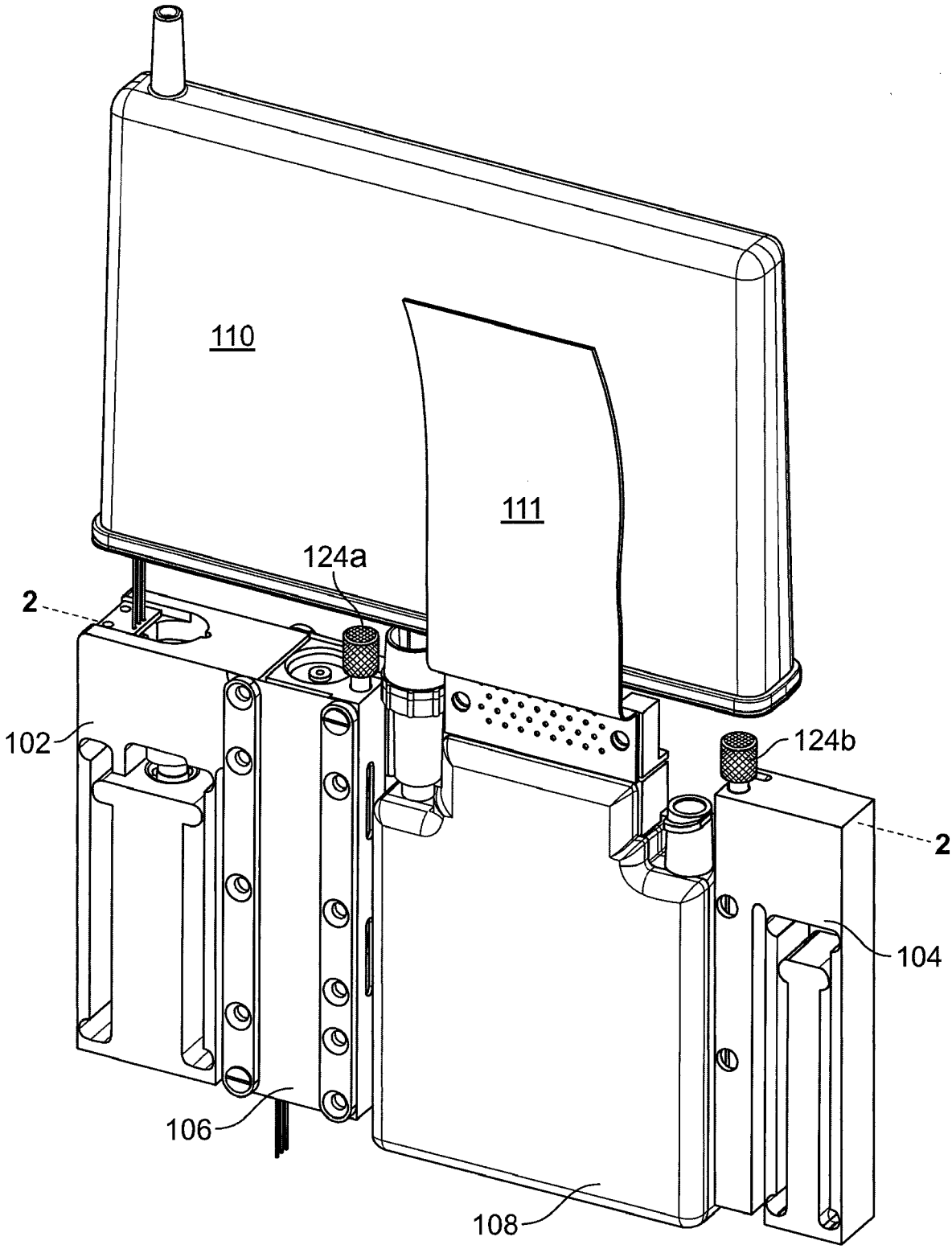
FIG. 2A is a perspective view of a mounting assembly, printhead assembly and fluid source.
Figure 2B:
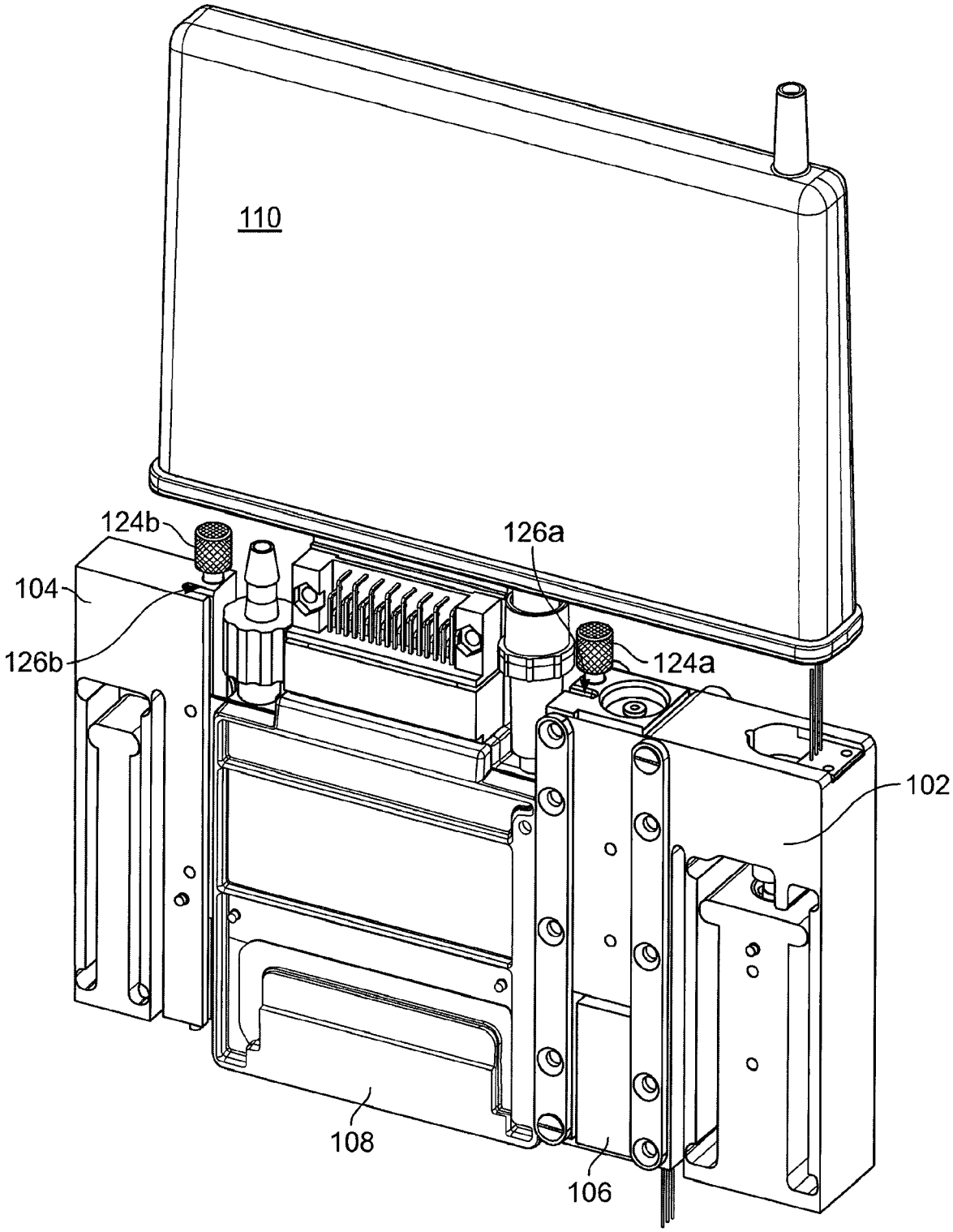
FIG. 2B is a perspective view of the mounting assembly shown in FIG. 2A in reverse.

Referring to FIGS. 2A and 2B, one implementation of the mounting assembly and the printhead assembly is shown. In this implementation, the mounting assembly includes an active first direction mount 102 and a passive mount 104. Additionally, an active second direction mount 106 is included, which is configured to adjust the position of nozzles included in the printhead assembly 108 in a second direction. A printing fluid source 110 is fluidly coupled to the printhead assembly 108. A flexible circuit 111 extends from the printhead assembly 108 and can electrically connect to a controller to provide electrical signals to the printhead assembly 108 to selectively fire the nozzles included therein.

Figure 2C:
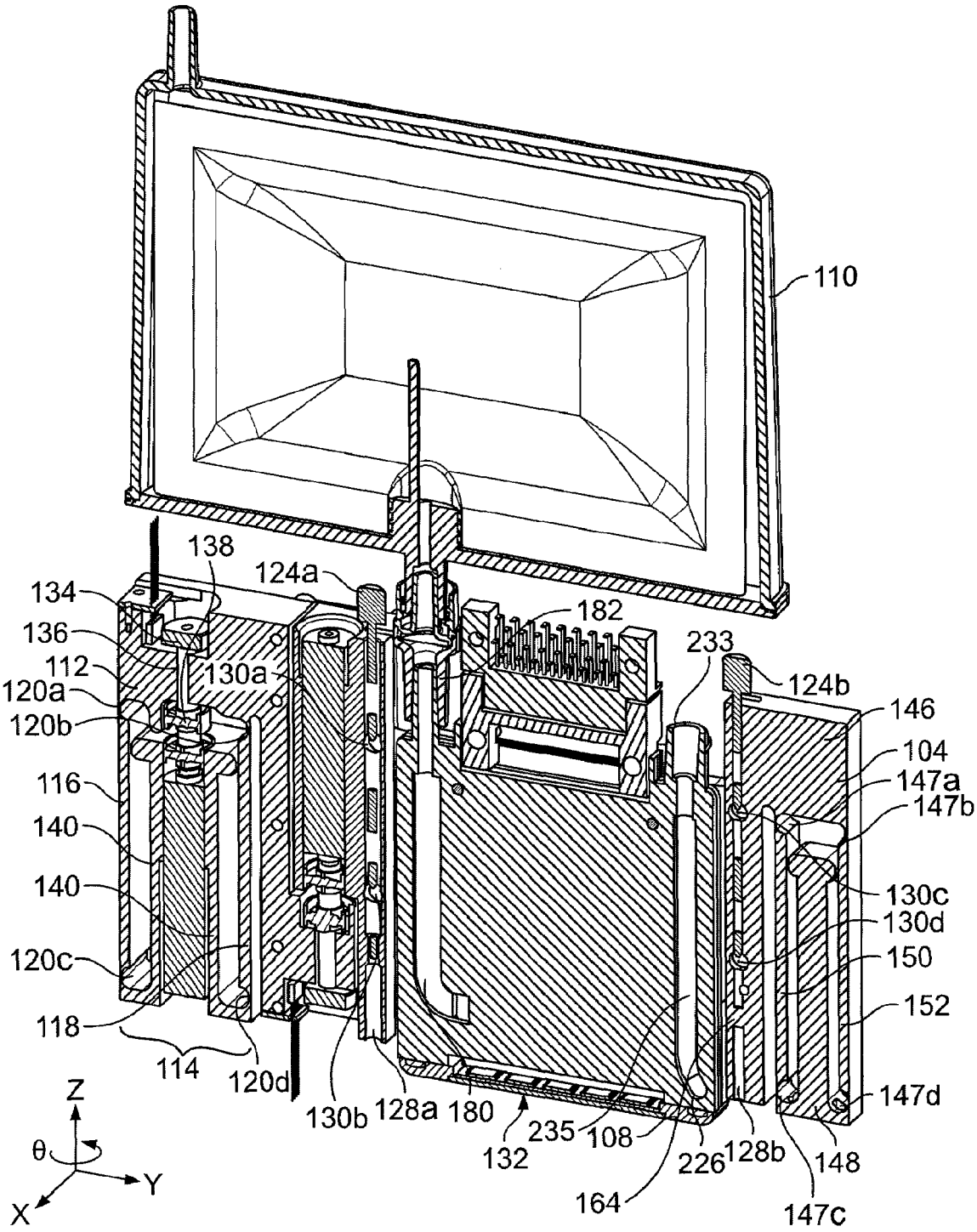
FIG. 2C is a cross-sectional perspective view of the mounting assembly shown in FIG. 2A taken along line 2-2.

Referring to FIG. 2C, a cross-sectional view along line 2-2 of the mounting assembly, printhead assembly 108 and printing fluid source 110 of FIG. 1 is shown. The active first direction mount 102 includes a top component 112, a bottom component 114 and two side components 116 and 118. The top, bottom and side components 112-118 substantially form a parallelogram. The bottom component 114 is fixed relative to the top and side components 112, 116 and 118, for example, the bottom component 114 can be screwed to a mounting structure. The top and side components 112, 116 and 118 can move in a first direction, which in the illustration shown is labeled the "y" direction, as shall be further described below. Although the bottom component 114 is fixed and cannot move in the y direction, because of the configuration of the active first direction mount 102, the top and bottom components 112, 114 remain substantially parallel to one another as the top component 112 moves in the y direction and the two side components 116, 118 remain substantially parallel to one another, thus the parallelogram configuration is maintained.

The two side components 116, 118 connect to the top and bottom components 112, 114 so as to allow the movement discussed above in the y direction. In the implementation shown, each side component 116, 118 connects to the top and bottom components 112, 114 with a connector 120*a-d* configured as a living hinge, allowing the side components to move in the y direction. Other configurations of connectors can be used to connect the side components 116, 118 to the top and bottom components, as long as movement in the first direction of the top and side components can occur.

Figure 3A:
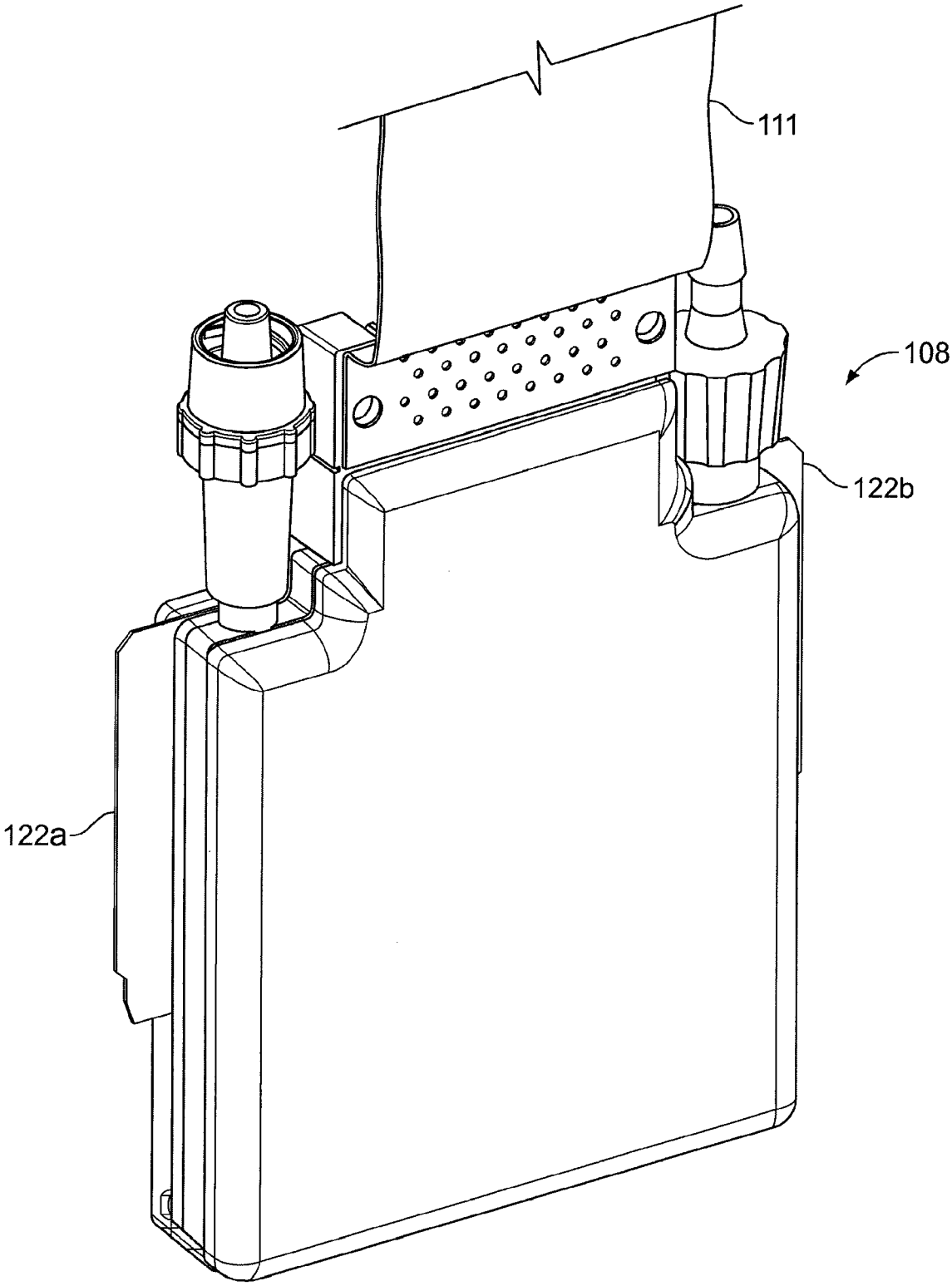
FIG. 3A is a perspective view of a printhead assembly.
Figure 3B:
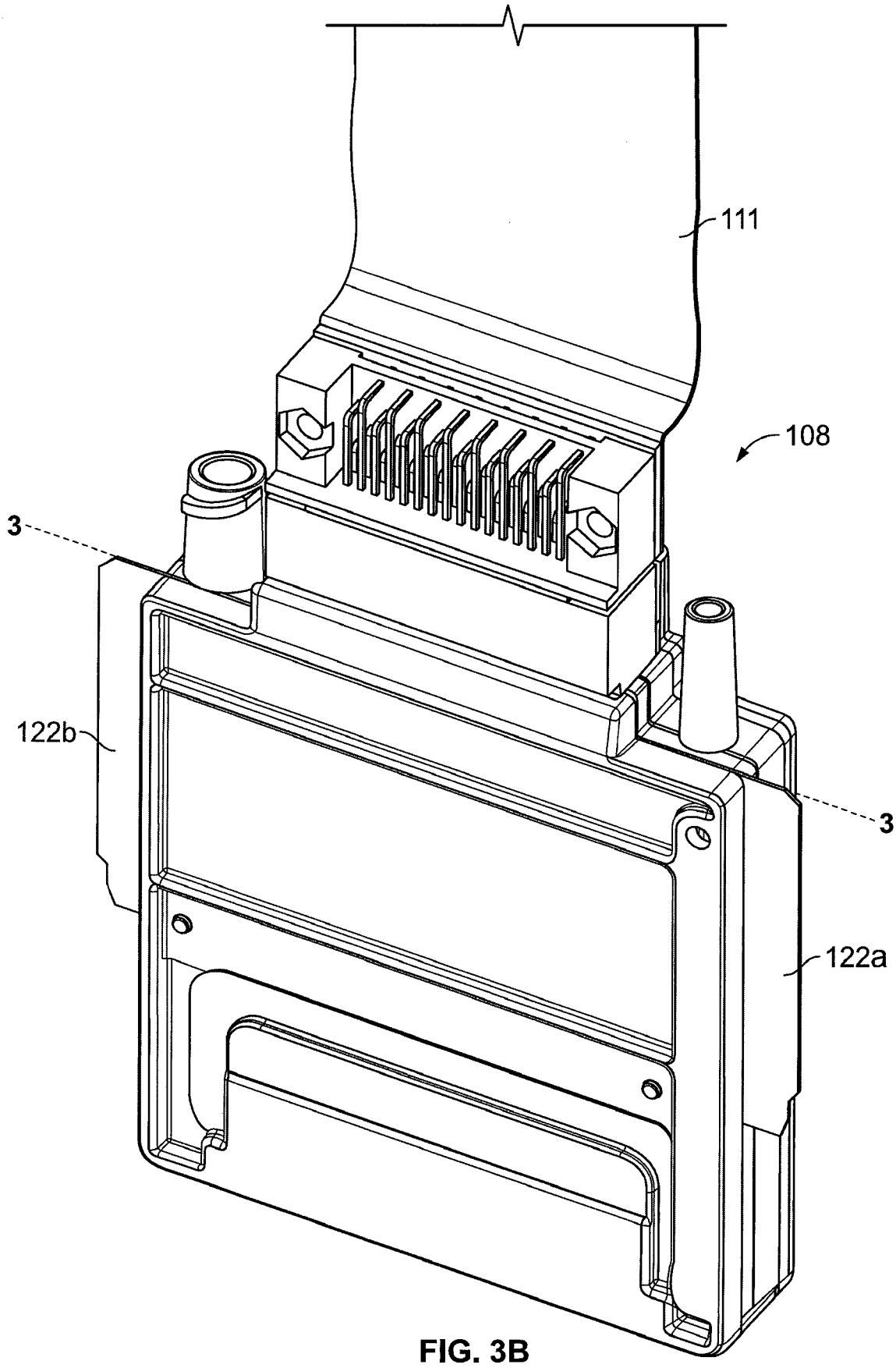
FIG. 3B is a perspective view of the printhead assembly of FIG. 3A in reverse.
Figure 3C:
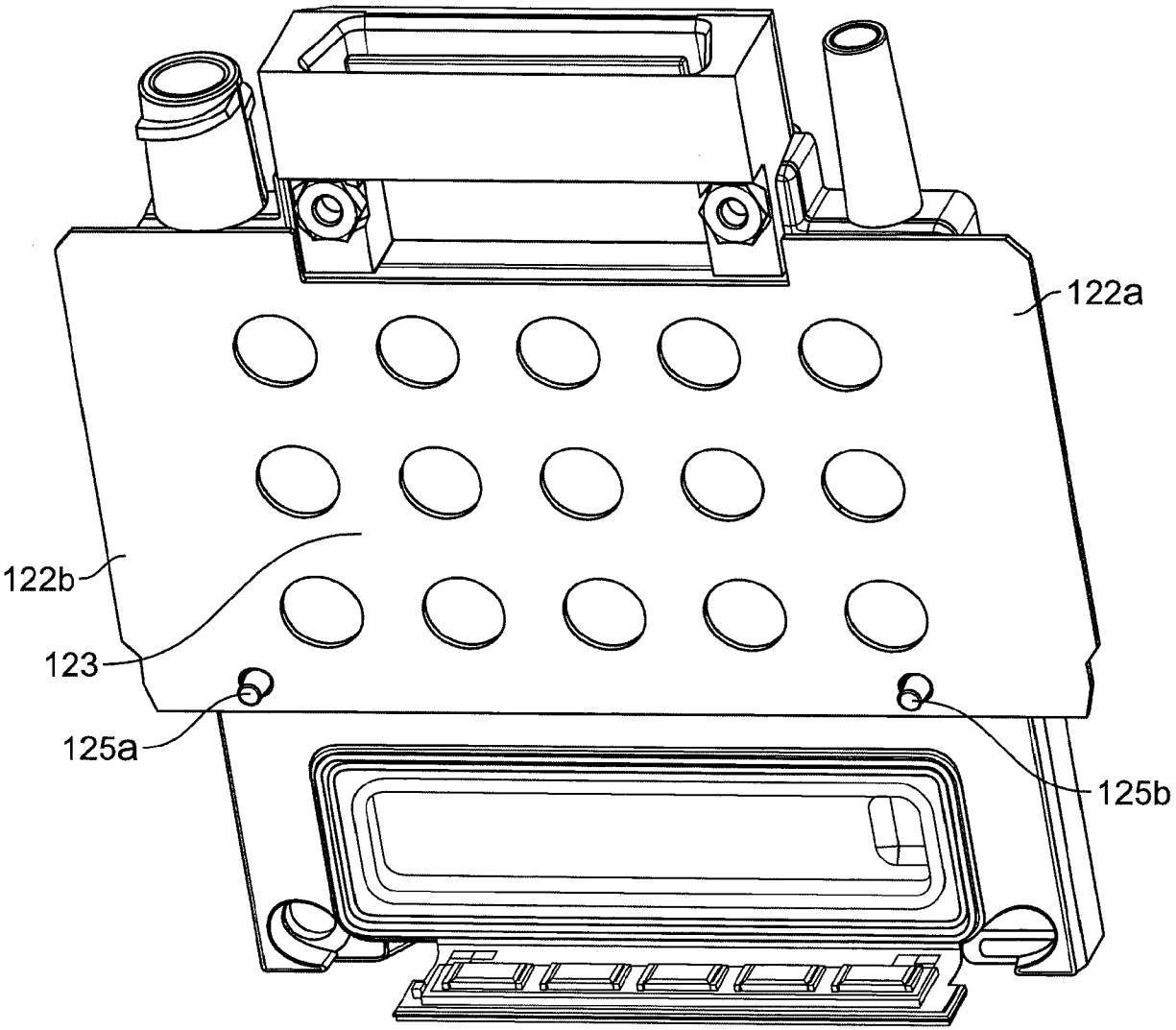
FIG. 3C is a cross-sectional view of the printhead assembly of FIG. 3B taken along line 3-3.

Referring to FIGS. 3A and 3B, the printhead assembly 108 is shown. In this implementation, the printhead assembly 108 includes mounting connectors configured as mounting plates 122*a-b* positioned on either side of the printhead assembly 108. Referring to FIG. 3C, a cutaway view of the printhead assembly 108 is shown that exposes the mounting plates 122*a-b*. In this implementation, they are formed as extensions from a single plate extending across the printhead assembly 108. In another implementation, each mounting plate 122*a-b* can be separate and independently affixed to the printhead assembly 108.

Referring again to FIGS. 2A-C, two mounting plate clamp screws 124*a-b* are used to connect the printhead assembly 108 to the mounting assembly via the mounting plates 122*a-b*. Each mounting plate 122*a-b* is received within a slot (see also element 126*a* in FIG. 5A) formed in an adjacent surface of the mounting assembly. In this implementation, a slot 126*a* is formed in the active second direction mount 106 to receive the first mounting plate 122*a* and a slot 126*b* is formed in the passive mount 104 to receive the second mounting plate 122*b*.

Once the mounting plates 122*a-b* are in place in the respective slots 126*a-b*, the mounting plate clamp screws 124*a-b* are slidably received in channels 128*a-b* formed in the mounting assembly. Channel 128*a* is formed in the active second direction mount 106 and channel 128*b* is formed in the passive mount 104. One or more elements included within the mounting assembly adjacent each channel 128*a-b* are urged against the respective mounting plates 122*a-b* when the mounting plate clamp screws 124*a-b* are screwed into their respective channels 128*a-b*. In this implementation, the elements are balls 130*a-d*, although in other implementations the elements can be configured differently and need not be spherical.

The mounting plate clamp screws 124*a-b* include regions of cammed (e.g., tapered) outer surfaces in the region of the balls 130*a-d*. For example, the region 141 shown in FIG. 5B is a cammed outer surface of mounting plate clamp screw 124*a*. As the mounting plate clamp screw 124*a* is threaded into the channel 128*a*, the region 141 of the outer surface moves relative to the ball 130*a* and tightens against the ball 130*a*, urging the ball 130*a* into contact with the mounting plate 122*a*. The pressure of the balls 130*a-d* against the mounting plates 122*a-b* is sufficient to hold the mounting plates 122*a-b* firmly in place. The printhead assembly 108 is thereby held securely to the mounting assembly via the mounting plates 122*a-b*.

Other techniques can be used to connect the printhead assembly 108 to the mounting assembly. The use of mounting plates 122*a-b* received in slots 126*a-b* and held in place by the mounting plate clamp screws 124*a-b* pressing against the balls 130*a-d* is but one implementation.

Because the printhead assembly 108 is secured to the mounting assembly, movement of the mounting assembly produces movement of the printhead assembly 108. Nozzles are included in a nozzle plate 132 positioned along the underside of the printhead included in the printhead assembly 108. The nozzles can be precisely positioned in at least the y direction and pivoted about the z axis in the θ direction by adjusting the position of the printhead assembly 108 in the y and θ directions using the active first direction mount 102 and the active second direction mount 106, as shall be described further below.

Figure 4A:
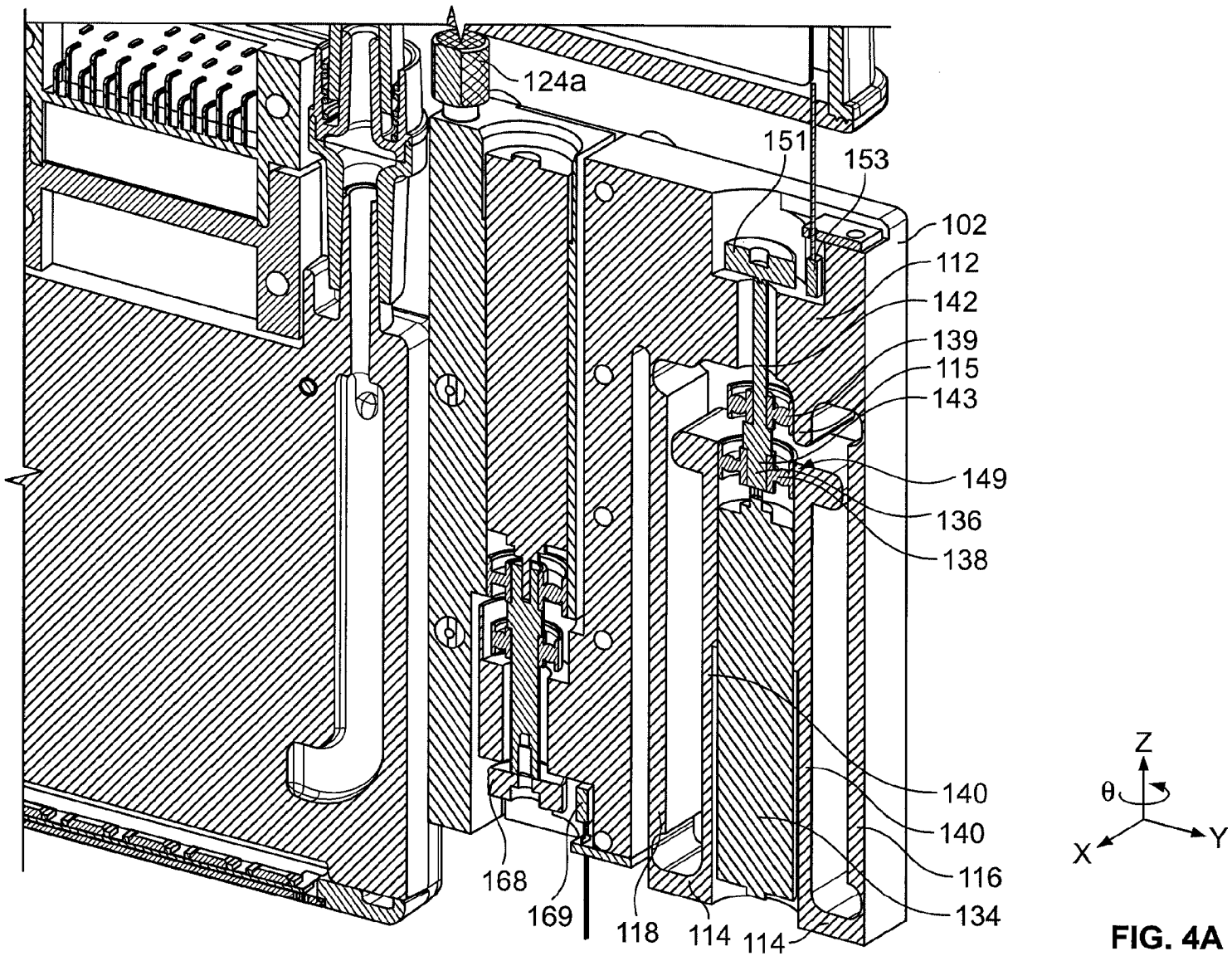
FIG. 4A is an enlarged cross-sectional view of a portion of the mounting assembly shown in FIG. 2B.

Referring first to the y direction, by controlling movement in the y direction of the active first direction mount 102, movement of the printhead assembly 108 and therefore the position of the nozzles in the y direction, can be controlled. Referring to FIG. 4A, an enlarged cross-sectional view of the active first direction mount 102 is shown. In this implementation, movement of the active first direction mount 102 in the first direction is controlled using a motor 134 that rotates a drive shaft 136, within a fixed bearing 138 and an eccentric bearing 139.

In this implementation, the motor 134 is positioned within a tower 140 that extends from the fixed bottom component 114. As the tower 140 is formed rigidly in relation to the bottom component 114, i.e., does not move relative to the bottom component 114, the tower 140 and the motor 134 included therein do not move in the y direction. The fixed bearing 138 rotates within the tower 140 with rotation of the drive shaft 136. An upper portion 142 of the drive shaft 136 is formed off-center the lower portion 143. That is, a longitudinal axis of the upper portion 142 is displaced from a longitudinal axis of the lower portion 143 and of the motor 134 and tower 140. The displacement can be relatively small, as the distance the nozzles are adjusted in the y direction is relatively small. For example, the displacement can be in the range of approximately 0.5 to 1000 microns.

The eccentric bearing 139 is in contact with a tongue 115 protruding from the top component 112 of the active first direction mount 102. The bearing 139 and tongue 115 are urged into contact with one another, for example, by a spring or flexure mechanism. Because the eccentric bearing 139 rotates off-center the lower portion 143 of the drive shaft 136, the point of contact 149 between the eccentric bearing 139 and the tongue 115 moves in the y direction, as is illustrated in FIGS. 4B-D.

Figure 4B:
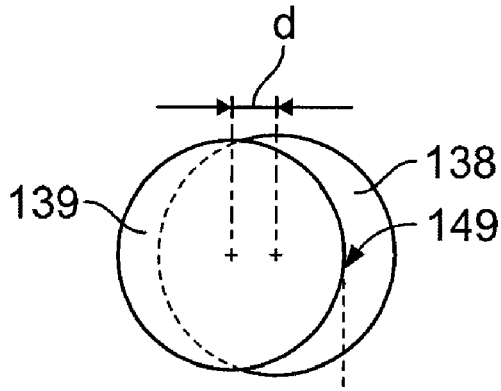
FIGS. 4B-D show a schematic representation of a top view of the fixed and eccentric bearings included in the active first direction mount included in the mounting assembly shown in FIGS. 2A-C.
Figure 4C:
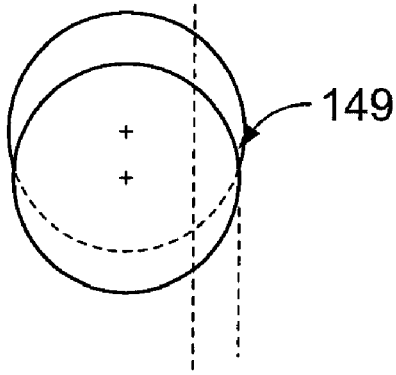
Figure 4D:
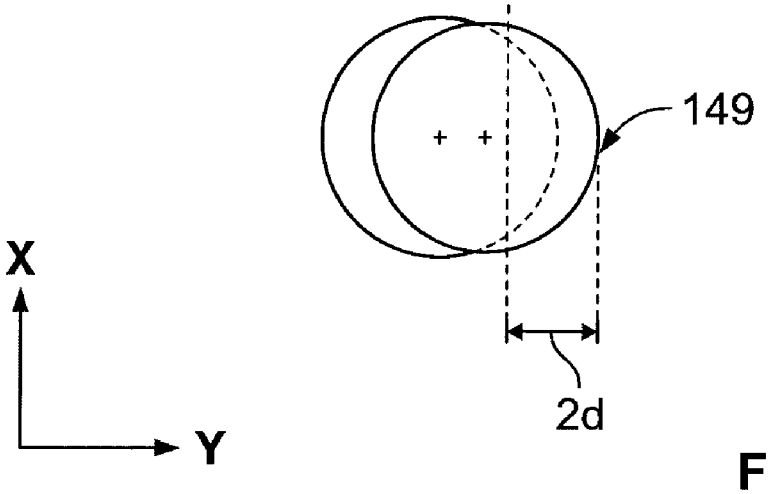

FIGS. 4B-D show a schematic, top, cross-sectional view of fixed bearing 138 and eccentric bearing 139. The point of contact 149 between the eccentric bearing 139 and the tongue 115 is also shown at different points during rotation of the bearings 138, 139. The figures illustrate how the point of contact 149 moves in the y direction as the eccentric bearing 139 rotates off-center the fixed bearing 138. During a ½ revolution of the eccentric bearing 139, the point of contact 149 moves by twice the displacement d of the center axis of the eccentric bearing 139 from the center axis of the fixed bearing 138.

Movement of the point of contact 149 results in movement of the tongue 115, which is connected to the top component 112 of the active first direction mount 102, and thereby moves the top component 112. As the top component is thereby driven in the y direction, the side components 116, 118 follow, as they are connected to the top component 112 with connectors 120*a* and 120*b*, which permit movement in the y direction. The tower 140 and bottom component 114 remained fixed in the y direction.

The printhead assembly 108, which is fixed to the active first direction mount 102 (in this implementation indirectly through the active second direction mount 106), is moved in the y direction along with the active first direction mount 102. In this manner, the position of the nozzles included in the printhead 133 within the printhead assembly 108 can be adjusted in the y direction.

Referring again to FIG. 4A, a magnetic disk 151 is positioned at the top of the drive shaft 136. The magnetic disk 151 is positioned within proximity to a Hall effect sensor 153. A Hall effect sensor measures the strength of a magnetic field. As the magnetic disk 151 moves nearer the Hall effect sensor 153, the magnetic field increases and as the magnetic disk moves away from the Hall effect sensor 153 the magnetic field decreases. The Hall effect sensor 153 is used to sense the position of the magnetic disk 151, from which the position of the drive shaft 136 in terms of a revolution count can be deduced.

In one implementation, the Hall effect sensor 153 is used to determine a home position, e.g., the position of the drive shaft 136 at which the magnetic field is either the highest or the lowest. In one implementation, the Hall effect sensor 153 can be used in conjunction with an encoder on the motor 134 to sense a rotation position. In one example, the encoder pulses 1024 per revolution of the drive shaft 136. Each pulse corresponds to four counts, and thus one revolution of the drive shaft 136 is the equivalent of 4096 counts. The position of the drive shaft 136 can be controlled at the level of counts, thereby providing high resolution positioning of the drive shaft 136 translating to high resolution adjustment of the nozzles in the y direction.

Referring again to FIG. 2C, the passive mount 104 shall be described. The passive mount 104 includes a top component 146, a bottom component 148 and two side components 150, 152. The bottom component 148 is fixed and cannot move in the y direction. The top, bottom and side components 146-152 substantially form a parallelogram. The top and bottom components 146, 148 of the parallelogram remain substantially parallel to one another as the top component 146 moves in the y direction while the bottom component 148 remains fixed. The side components similarly remain substantially parallel to one another as they move in the y direction. The side components 150, 152 connect to the top and bottom components 146, 148 by flexible connectors 147*a-d*. For example, in the implementation shown, the connectors are configured like living hinges. In other embodiments, other connector configurations can be used that allow for relative movement in the y direction.

The top and side components 146, 150, 152 move in the y direction in response to the active first direction mount 102 being driven in the y direction, by virtue of the passive mount 104 being indirectly connected to the active first direction mount 102 via the printhead assembly 108. The passive mount 104 does not itself include a drive mechanism and is thereby "passive" as compared to "active".

In another implementation, the passive mount 104 can be replaced by a second active first direction mount that includes a drive mechanism similar to the active first direction mount 102 described above.

In another implementation, the passive mount can be configured differently, so long as the printhead assembly 108 is held securely and is permitted to move in the y direction in response to movement of the active first direction mount 102.

In the implementation shown, the mounting assembly further includes an active second direction mount 106. The active second direction mount 106 is configured to provide controlled movement in a second direction, which in this implementation is a rotation of the angle θ about the z axis. Because the active second direction mount 106 is connected to the printhead assembly 108, the printhead assembly 108 pivots in the θ direction in response to the controlled movement of the active second direction mount 106 in the θ direction. In this manner, the position of the nozzles included in the printhead assembly 108 can be adjusted in the θ direction.

Figure 5A:
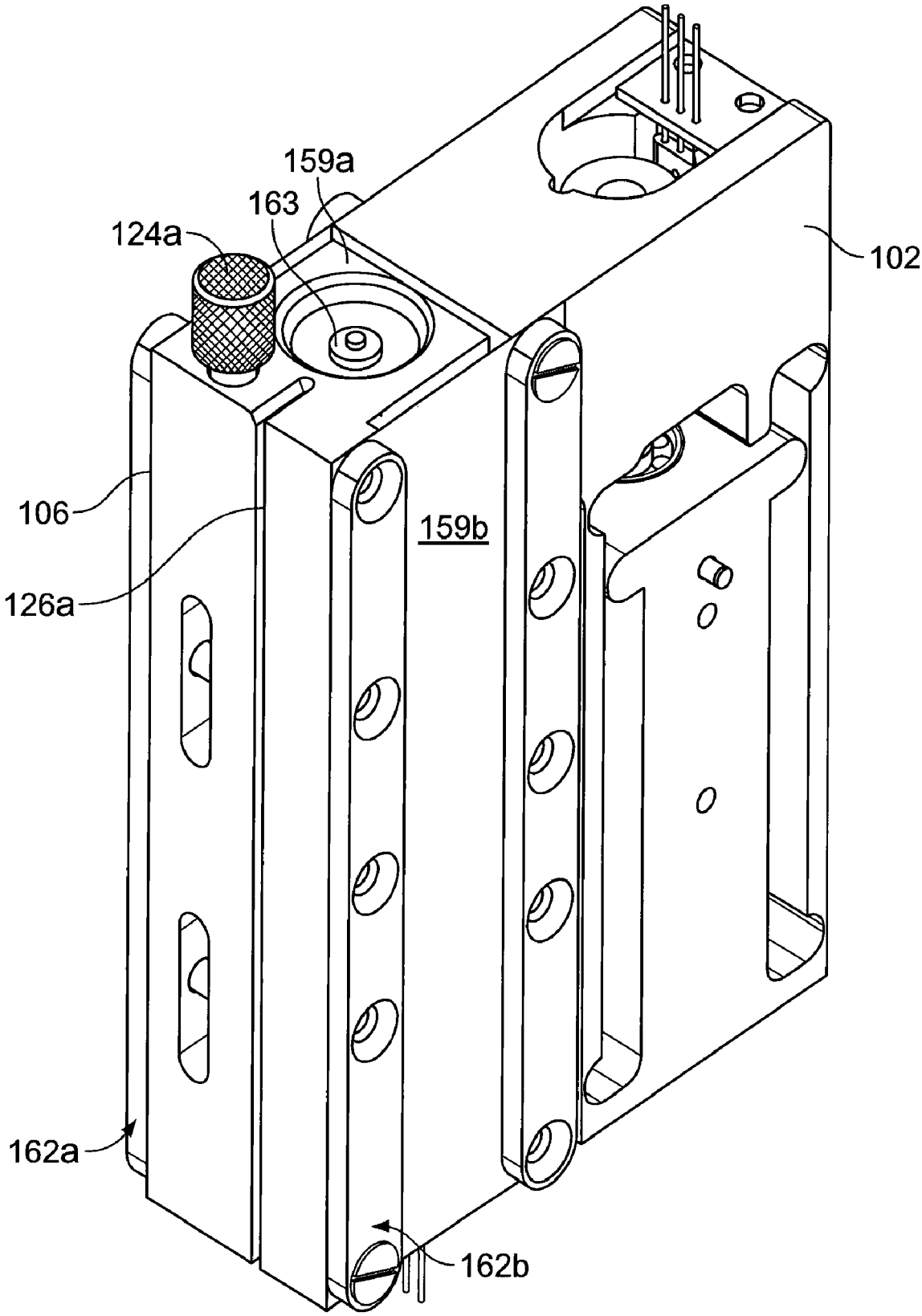
FIG. 5A shows a perspective view of the active second direction mount and the active first direction mount included in the mounting assembly shown in FIGS. 2A-C.
Figure 5B:
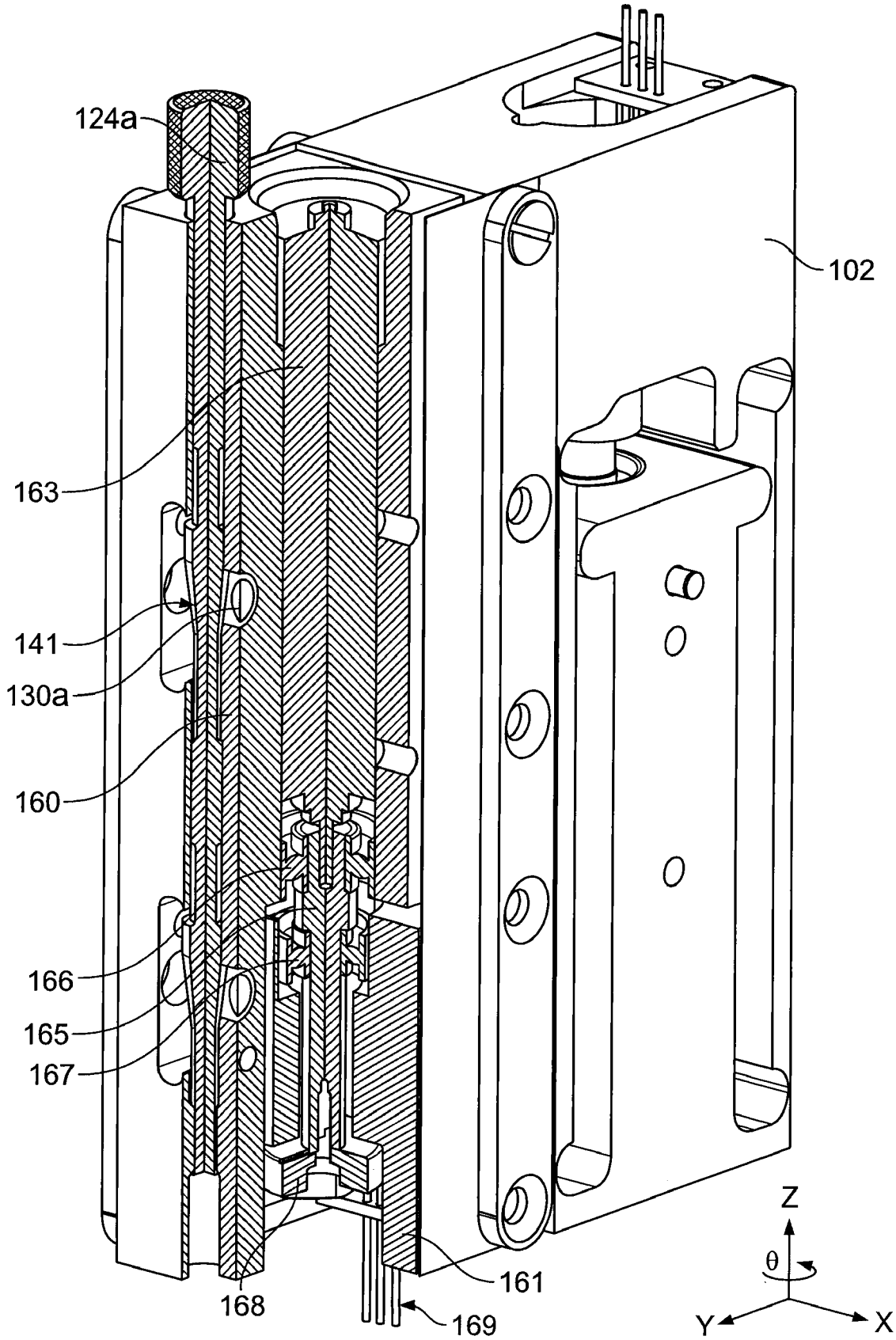
FIG. 5B shows a cutaway view of the active second direction and first direction mounts shown in FIG. 5A.

Referring to FIG. 5A, a perspective view of the active second direction mount 106 and the active first direction mount 102 is shown. The two active mounts are connected by way of thin flexures 159*a* and 159*b*, which are bolted to the active first and second direction mounts 102, 106. A slot 126*a* formed in the active second direction mount 106 is shown, which is configured to receive the mounting plate 122*a* included in the printhead assembly 108.

Figure 5C:
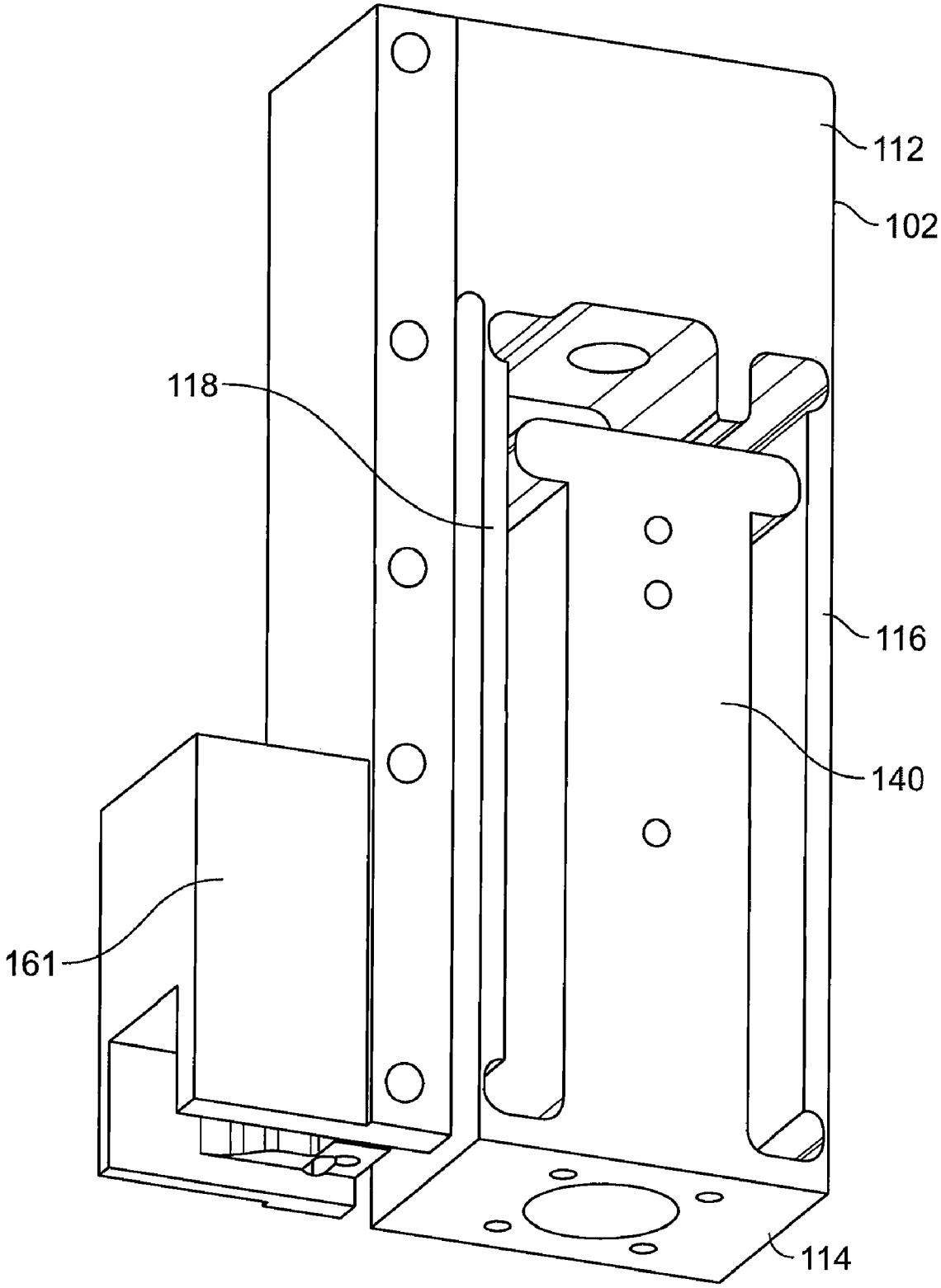
FIG. 5C shows a perspective view of a portion of the active second direction and first directions mounts shown in FIG. 5A.

Referring to FIG. 5B, the perspective view of FIG. 5A is shown with a corner of the active second direction mount 106 cut away to reveal the inner workings of the active second direction mount 106. The active second direction mount 106 includes an upper structure 160 and a lower structure 161. Referring to FIG. 5C, the lower structure 161 is attached to the active first direction mount 102. Referring again to FIGS. 5A and 5B, the upper structure 160 includes the slot 126*a* configured to received the mounting plate 122*a* from the printhead assembly 108. The upper structure 160 connects to the thin flexures 159*a* and 159*b*, in this embodiment by bolts 162*a-b*. Although the upper structure 160 is bolted to the thin flexures 159*a-b* that are also connected to the active first direction mount 102, which is connected to the lower structure 161, there is some relative movement permitted between the upper structure 160 and the lower structure 161. The relative movement is permitted by reason of the thin flexures 159*a-b* being configured to permit some degree of flexing in the θ direction, thereby permitting the upper structure 160 to move in the θ direction. Because the upper structure 160 is connected to the printhead assembly 108 (i.e., via the slot 126*a*, mounting plate 122*a* and the mounting plate clamp screw 124*a*), movement of the upper structure 160 in the θ direction results in movement of the printhead assembly 108 in the same direction, as shall be described further below.

Referring to FIG. 5B, the active second direction mount 106 includes a motor 163 configured to rotate a drive shaft 165. The drive shaft 165 is connected to and rotates an upper bearing 166 and a lower bearing 167. The lower bearing 167 is connected to a lower portion of the drive shaft 165, which lower portion is off-centered from the upper portion and motor 163. That is, a longitudinal axis centered in the lower portion of the drive shaft is displaced off-center from a longitudinal axis centered in the motor 163 and upper portion of the drive shaft 165. The displacement of the longitudinal axes of the upper and lower portions of the drive shaft 165 causes relative eccentric movement between the upper and lower bearings 166, 167. However, because the lower bearing 167 rotates within the lower structure 161, which is fixed to the active first direction mount 102, the relative eccentric movement causes the upper structure 160 to move in the x direction between the thin flexures 159*a-b*.

As discussed above, the upper structure 160 is connected to one end of the printhead assembly 108. The opposite end of the printhead assembly 108 is connected to the passive mount 104, which is not free to move in the x direction. Accordingly, movement of the end of the printhead assembly 108 connected to the active second direction mount 106 causes the printhead assembly 108 to pivot in the θ direction, the pivot point being the opposite end of the printhead assembly 108 attached to the passive mount 104 and the axis of rotation being the z axis. The position of nozzles included in the printhead 133 thereby can be adjusted in the θ direction.

Referring again to FIG. 5B, a magnetic disk 168 is included at the lower end of the drive shaft 165. A Hall effect sensor 169 (see FIG. 4A) is in proximity to the magnetic disk 168. The rotation motion of the magnetic disk 168 is eccentric relative to the rotation of the upper bearing 166 and upper portion of the drive shaft, and thereby moves further to and away from the Hall effect sensor 169 as the motor rotates the drive shaft 165. As was described above in reference to the active first direction mount 102, the Hall effect sensor 169 can be used to detect a home position and monitor the position of the drive shaft 165 and thereby provide the nozzle positions in the θ direction.

Figure 6A:
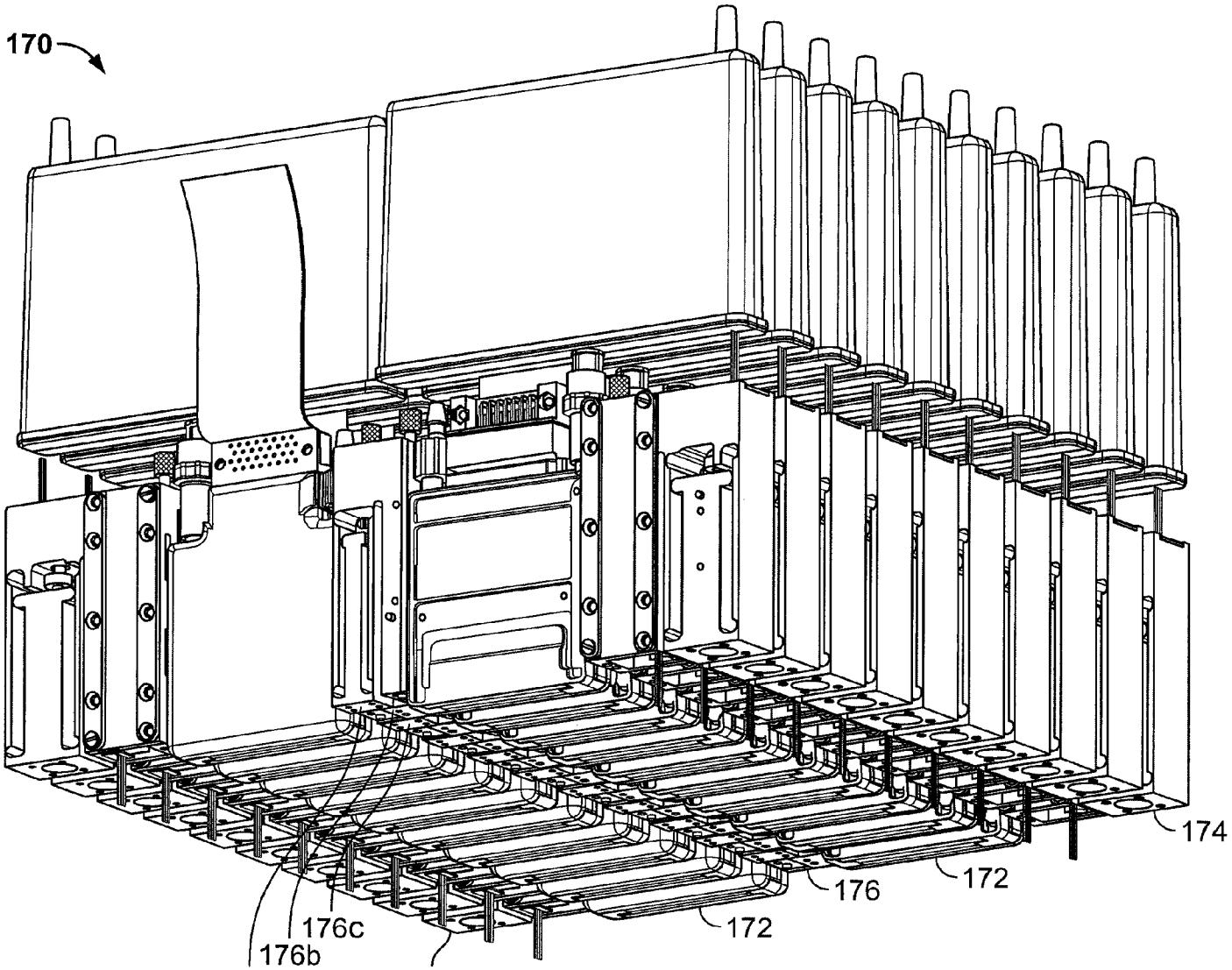
FIG. 6A shows an array of mounting assemblies, printhead assemblies and fluid sources.

Referring to FIG. 6A, an array 170 of printhead assemblies 172 mounted within mounting assemblies 174 is shown. The printhead assemblies 172 are positioned relative to one another such that the nozzles included in each printhead assembly 172 are precisely aligned for printing with the array 170 as a whole. In the implementation shown, the position of the mounting assemblies 174 included on the left side of the array 170 is opposite to the position of the mounting assemblies 174 included on the right side of the array. Accordingly, the passive mounts 176 of the both the left set of mounting assemblies 174 and the right set of mounting assemblies 174 are positioned toward the center of the array 170. To compactly arrange the mounting assemblies 174 within the array, the passive mounts 176 of both the left and right sets of mounting assemblies 174 are aligned and alternate one another. That is, a bottom view of the passive mounts 176 arranged down the center of the array shows a first passive mount 176*a* from the right set of mounting assemblies adjacent a second passive mount 176*b* from the left set of mounting assemblies, which is turn is adjacent a third passive mount 176*c* from the right set of mounting assemblies, and so on. Staggering the mounting assemblies 174 from the left and right set of mounting assemblies 174 allows for a smaller overall footprint of the array 170 and closer spacing of the nozzles included in the corresponding printhead assemblies 172.

Figure 6B:
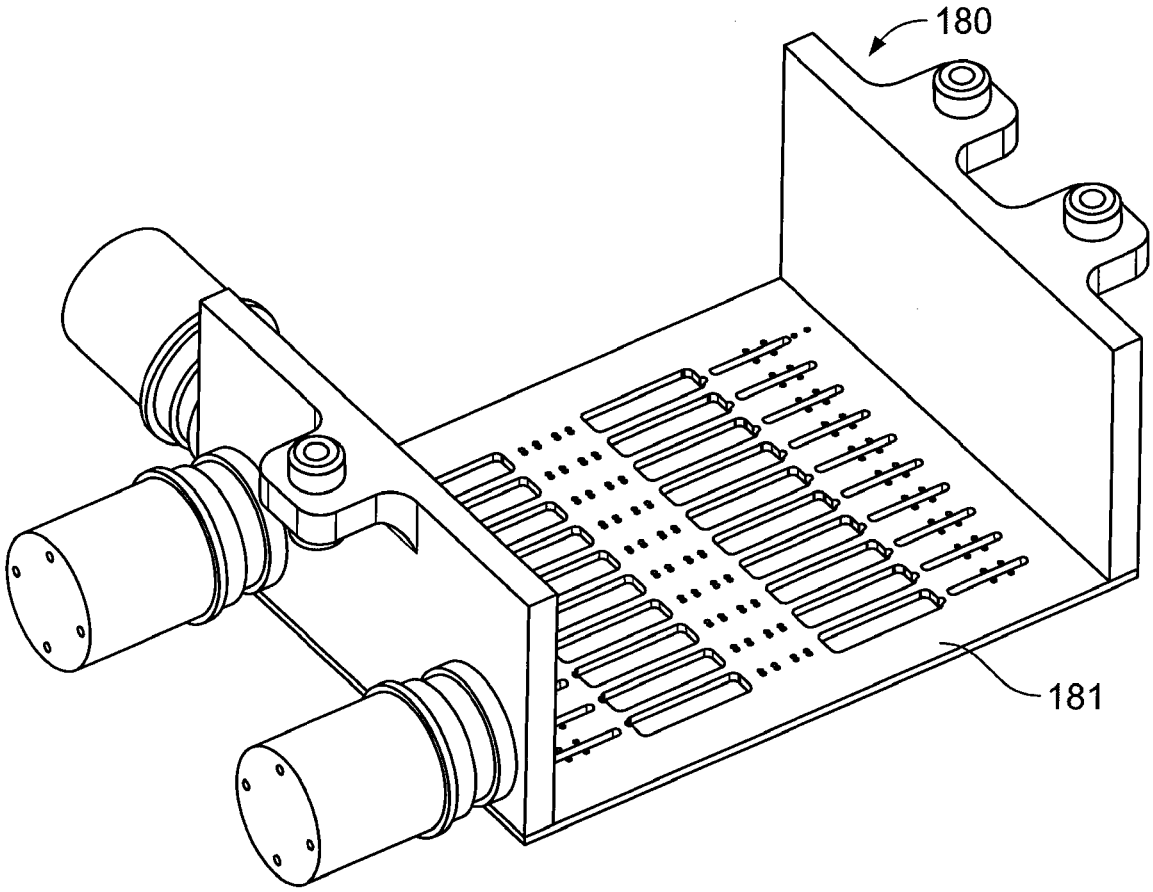
FIG. 6B shows an example of a mounting structure for the array shown in FIG. 6A.

Referring to FIG. 6B, one example implementation of a mounting structure 180 in which the array 170 of mounting assemblies can be mounted is shown. In this implementation, the mounting assemblies are affixed to the mounting structure 180, for example, using bolts, and apertures are included in the lower plate 181 to expose the nozzles included on the printheads 133 included in each printhead assembly 108 to a substrate that can be positioned beneath the mounting structure 180.

In one implementation, each printhead includes 128 nozzles. The drop size of a fluid ejected from a nozzle is in the range of approximately 1-5 picoliters, which produces a printed dot size in the range of approximately 5-15 microns. Therefore, in an application where 50% dot overlap is desired, the dot-on-dot placement can be resolved to within 2.5 microns. In one implementation, the position of the nozzles in the x, y and θ directions can be adjusted within the range of approximately 0.5 to 1000 micron and within a ½ micron accuracy.

In one implementation, the mounting assembly can be fabricated from a high-stiffness material such as stainless steel or a high stiffness polymer. Some illustrative examples of high stiffness polymers includes glass-filled liquid crystal polymers and carbon-filled liquid crystal polymers. Some or all of the components of the mounting assembly can be machined or injection molded. For example, injection molded three dimensional components can be fabricated and used together with flat flexible portions, e.g., the mounting plates 122*a-b* and/or the flexures 159*a-b*.

In one implementation, the motors 134 and 163 can be stepper motors with a home sensor. The motors include can include a high gear reduction gearbox, for example, a 1000 to 1 gear ratio. In another implementation, one or both of the motors 134, 163 can be a DC motor with a high gear reduction gearbox and an encoder. In other implementations, other suitable motors can be used.

Figure 7:
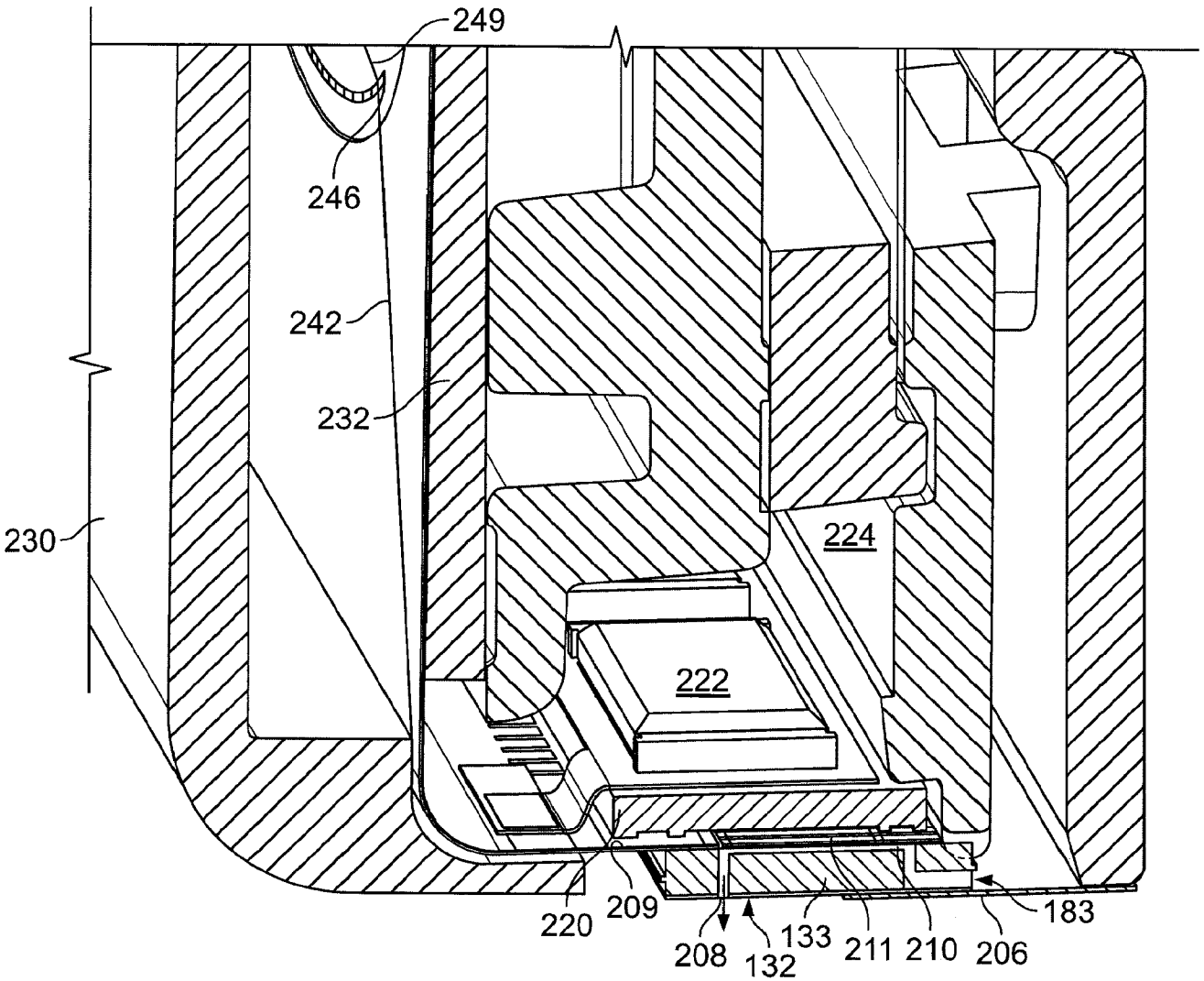
FIG. 7 shows an enlarged cross-sectional view of a portion of the printhead assembly shown in FIGS. 3A and 3B.

Referring again to FIGS. 2A-3B, the printhead assembly 108 included in the implementation shown shall be described in further detail. The printhead assembly 108 includes a housing. The housing includes a fluid conduit 180 that provides fluid communication between a fluid inlet 182 and inlets 183 included in the printhead 133 (see FIG. 7). The fluid conduit 180 is configured to connect to the fluid source 110.

Figure 8:
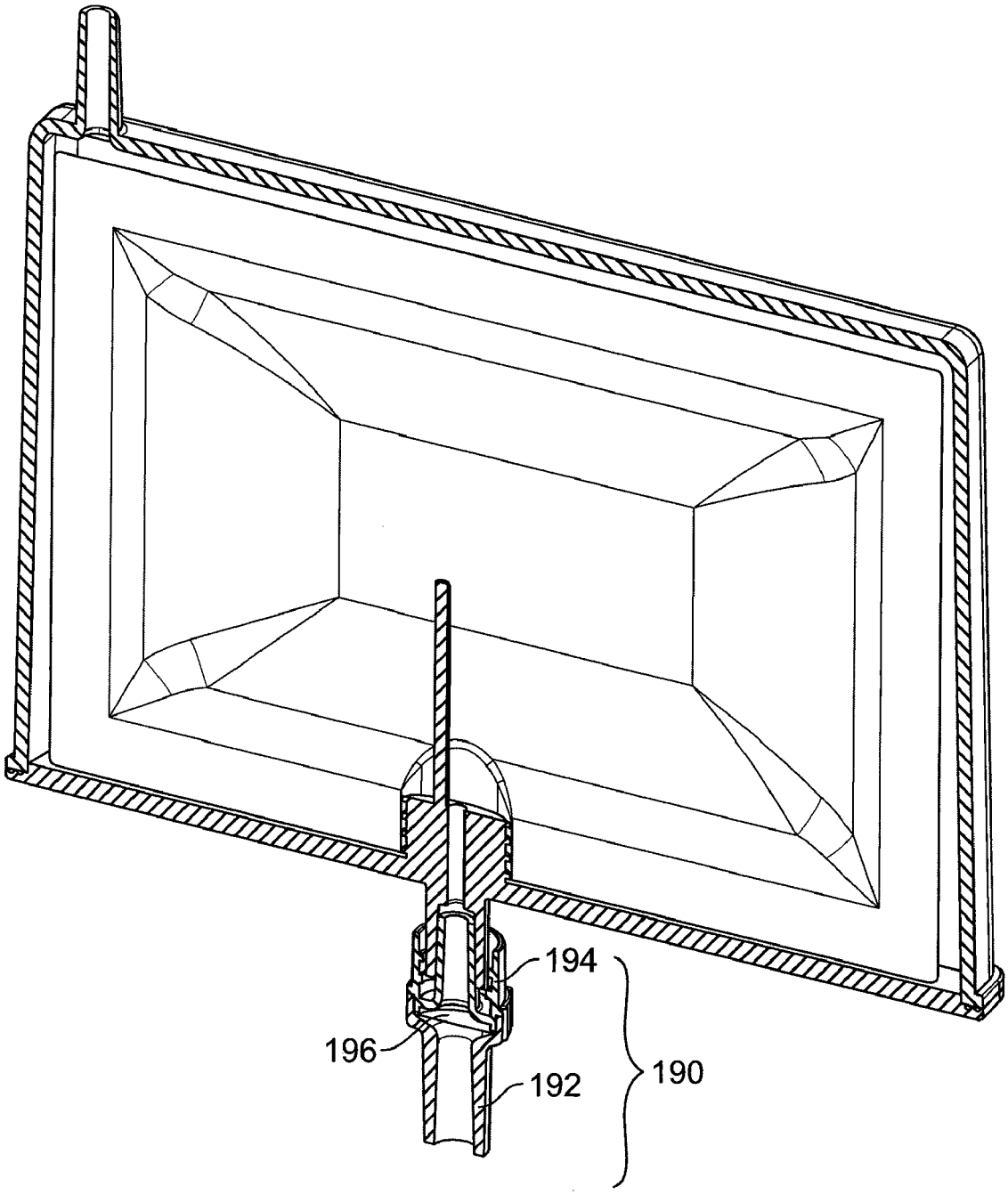
FIG. 8 shows a cross-sectional view of the fluid source shown in FIGS. 2A-C.

Referring to FIG. 8, in the implementation shown, an optional filter assembly 190 is included between the fluid inlet 182 and the fluid source 110. The filter assembly 190 includes a female portion 192 configured to receive the corresponding male configured fluid inlet 182. The filter assembly 190 further includes an upper portion 194 configured to mate to the fluid source 110. In this implementation, luer fittings are used to connect the filter assembly 190 to the fluid source 110 and to the fluid inlet 182. A filter 196 is provided within the fluid pathway formed between the upper portion 194 and the female portion 192. The filter 196 can be formed from a woven material, e.g., a woven stainless steel or plastic (e.g., nylon, Teflon, polyethylene or polypropylene), and configured to prevent impurities included within the fluid source 110 from remaining in the fluid stream passing into the printhead assembly 108.

Figure 9:
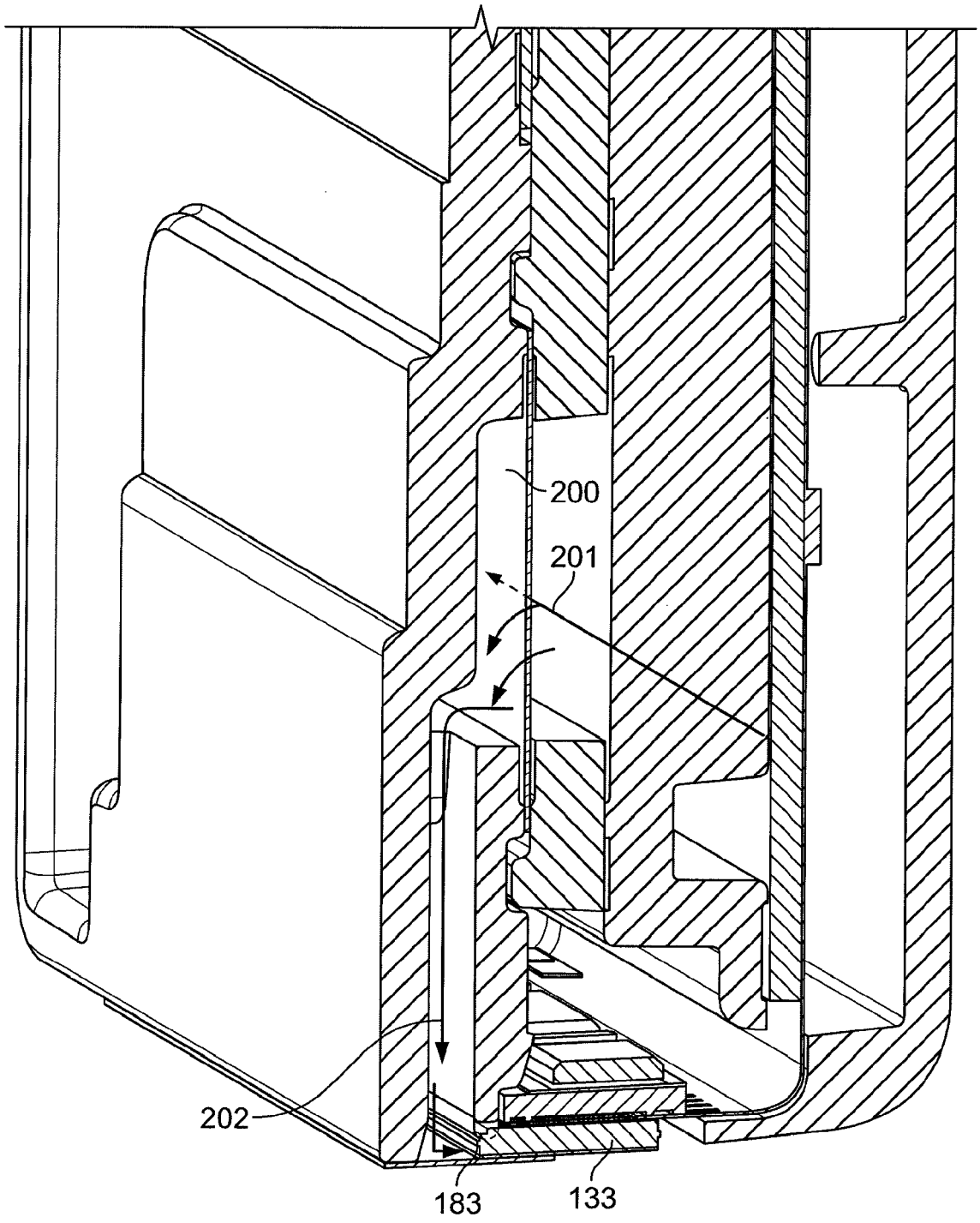
FIG. 9 shows an enlarged cross-sectional view of a portion of the printhead assembly shown in FIGS. 3A and 3B.

Referring to FIG. 2C, a vertical portion of the fluid conduit 180 formed within the housing of the printhead assembly 108 is shown. The fluid conduit 180 further includes a horizontal portion, which is not shown in the particular cross-sectional view provided. Referring now to FIG. 9, an enlarged partial cross-sectional view of the printhead assembly 108 is shown. Arrows 201 indicate a path of a fluid traveling from the fluid inlet 182 through the fluid conduit 180. A cross-sectional view of the horizontal portion of the fluid conduit 180 is shown. The fluid travels in the direction of the arrows and must pass through a filter 200 to continue in a vertical direction 202 toward the inlets 183 to pumping chambers included in the printhead 133. Referring again to FIG. 7, the path of the fluid upon reaching the inlets 183 is shown by arrow 206, culminating at the individual nozzles 208 formed in the nozzle plate 132.

In this implementation, fluid within a pumping chamber 210 can be selectively discharged through the corresponding nozzle 208 by providing voltage to one or more piezoelectric actuators. A piezoelectric actuator is positioned over each pumping chamber 210 and includes a piezoelectric material 211 configured to deflect and pressurize the pumping chamber 210, so as to eject fluid from the corresponding nozzle 208 that is in fluid communication with the ejecting end of the pumping chamber 210.

Figure 12:
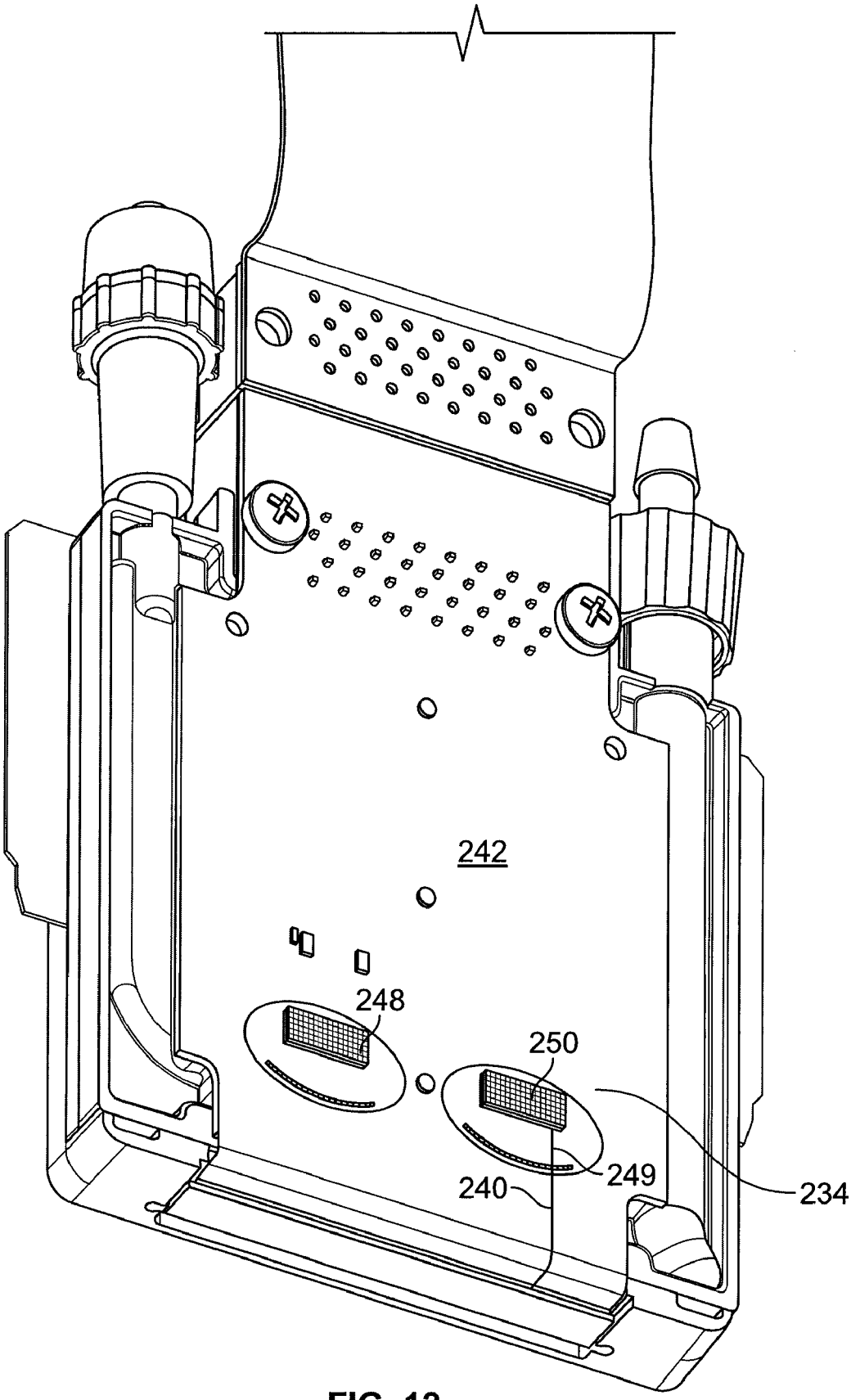
FIG. 12 shows a cutaway view of the printhead assembly shown in FIG. 2A.

The piezoelectric actuator can be actuated by applying a voltage differential across the piezoelectric material. In this implementation, a drive contact corresponding to each pumping chamber is located on the underside of the piezoelectric material 211. The drive contact is electrically connected to a trace connecting to a pad located on the backside of the flex circuit 111. Referring to FIG. 12, one example of a trace 240 on the backside 242 of the flex circuit 111 is shown. The trace 240 electrically connects at one end to a drive contact located on the piezoelectric material 211 and on the other end at the pad 246 located on the backside 242 of the flex circuit 111. In the implementation shown, one pad is included for each of the 128 drive contacts corresponding to each of the 128 nozzles included in the printhead 133. Each pad is electrically connected, for example by wire bond 249, to one of the ASIC circuits 248 or 250 shown attached to the backside 242 of the flex circuit 111. Each ASIC is electrically connected via the flex circuit 111 to a controller that provides drive signals to selectively activate each of the 128 nozzles. In FIG. 12, for the purpose of simplicity of the drawing and to avoid congestion, only one trace 240 and wire bond 249 are shown. However, a trace and wire bond can exist for each of the 128 nozzles included in the nozzle assembly, and accordingly in reality there could be 128 traces and 128 wire bonds as between the two ASICs 248 and 250.

Referring again to FIG. 7, on an upper surface of the flexible circuit 111, a ground contact 209 is included providing a ground, such that a voltage differential as between the ground and the drive contact can be applied to the piezoelectric material. The ground is applied through to the piezoelectric material 211 via a silicon die 220. As shown in the figure, the right side of the die 220 connects to the right side of the piezoelectric material 211. The die is metalized and conductive, thereby providing a ground at the right side of the piezoelectric material. The piezoelectric material to the immediate left of the grounded portion includes, on the underside, the drive contacts. Accordingly, when current is applied to the drive contacts, a voltage differential exists across the piezoelectric material 211 by virtue of the ground on the upper surface and the drive contact on the underside.

Figure 10:
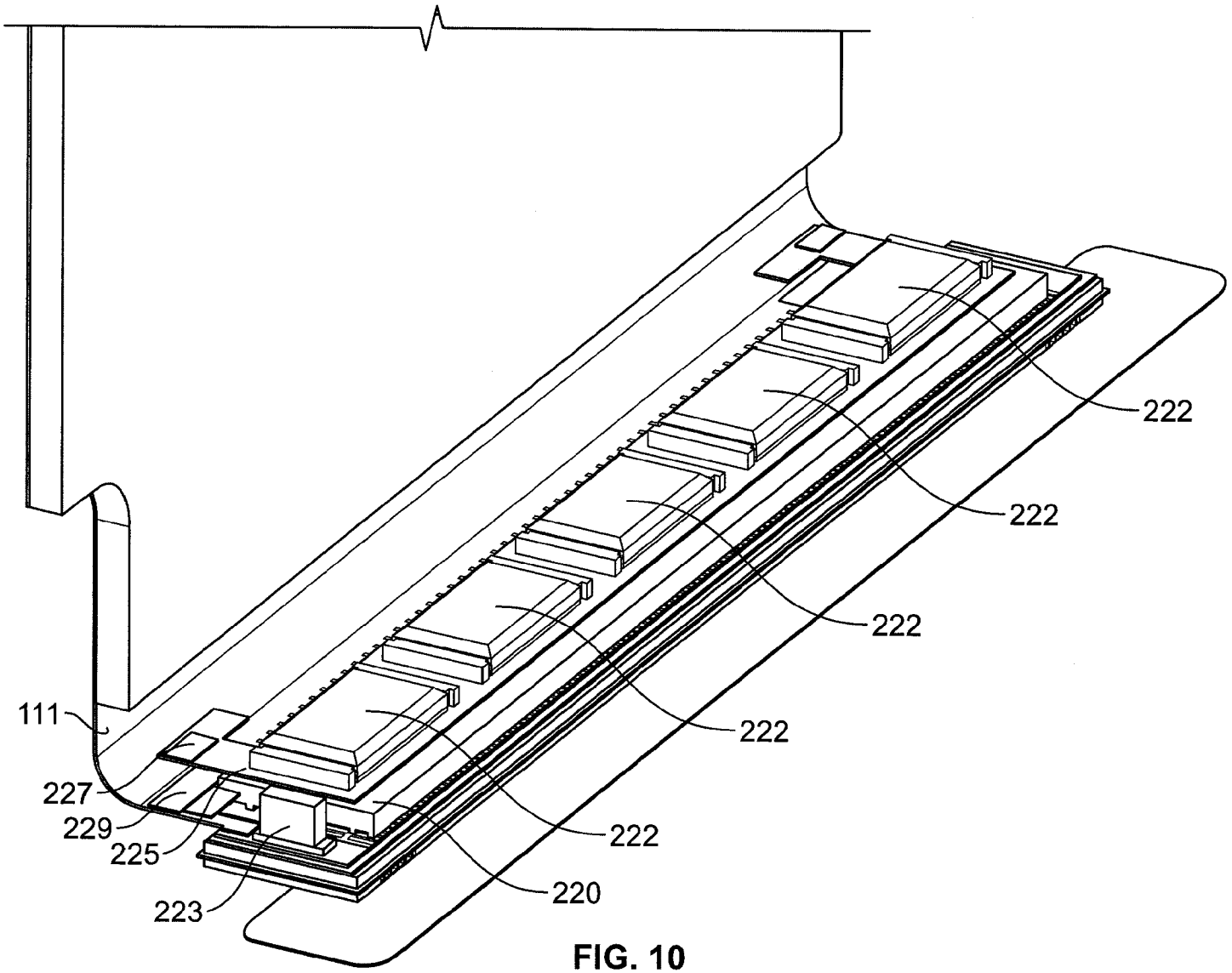
FIG. 10 shows a cutaway view of a portion of the printhead assembly shown in FIGS. 3A and 3B.
Figure 11:
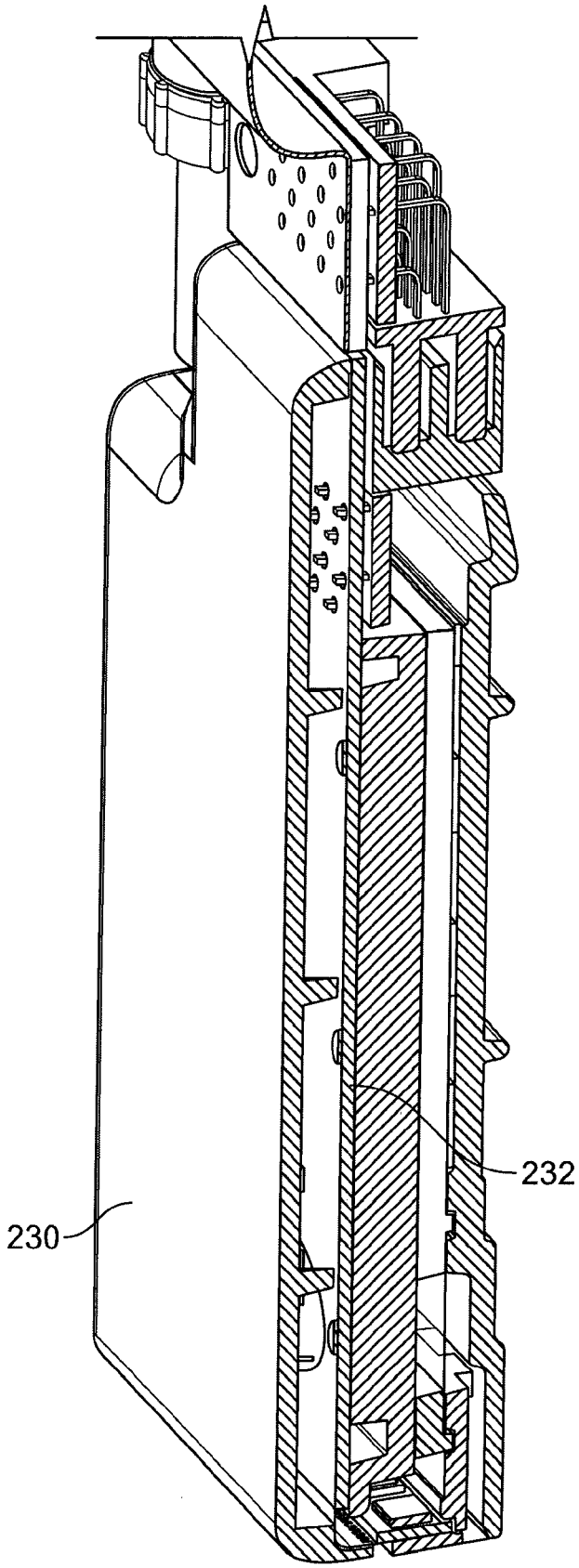
FIG. 11 shows a cross-sectional view of the printhead assembly shown in FIG. 3A.

The silicon die 220 additionally can act to conduct heat to the printhead 133. FIG. 10 shows a cutaway view exposing the die 220. One or more heaters 222 can be positioned on an upper surface of the die 220. In one implementation, the heaters 222 are resistors and a current is applied to the heaters 222, which are arranged in series, by a contact 227 formed on a flexible circuit 225. The contact 227 electrically connects to contact 229 formed on an upper surface of the flexible circuit 111. A thermistor 223 is electrically connected to the flexible circuit 111 provides a temperature reading of the die to a controller, the controller controlling the current supplied to the heaters 222 accordingly. For the purpose of being able to show the contact 229 formed on the flexible circuit 111, the flexible circuit 225 is shown in an extended position. However, when assembled, the flexible circuit 225 would actually be positioned such that the contact 227 mated with the contact 229 on the flexible circuit 111.

The input of heat into the housing of the printhead assembly 108 can be required in some applications to raise the temperature of the printing fluid to a desired temperature and therefore viscosity. For example, if the printing fluid is ink, to prevent coagulation of the ink, the ink may need to be maintained within a certain range of temperature that exceeds ambient temperature.

In other applications, it may be desirable to introduce a cooling source into the housing of the printhead assembly 108. As one example, to optimize drop ejection the temperature of the printhead 133 may need to be below ambient temperature. In another example, when printing over a heated platen area that can cause the printhead 133 to be heated beyond its temperature set point, cooling may be necessary to reduce the temperature to the desired set point. In another example, printing at high duty cycles can cause the nozzle plate 132 to self heat beyond the current set point, and again, cooling maybe necessary to reduce the temperature to the desired set point.

Referring again to FIG. 7, in the printhead assembly 108 implementation shown, cooling is achieved by injecting a cool dry gas into a region 224 near the printhead 133 and the temperature servo loop is then closed with one or more heaters built into the printhead, e.g., heaters 222, in conjunction with a thermistor 223 mounted close to the active part of the printhead. By providing cooling and heating sources within the printhead assembly 108 in the vicinity of the printhead 133, the temperature of the printing fluid at the printhead 133 can be controlled and a desired temperature maintained. In one implementation, the gas is used to force the temperature in region 224 down to a range where the heaters 222 can control the temperature at the nozzles.

Referring again to FIG. 2C, a gas inlet 233 formed within the housing of the printhead assembly 108 can be used to fluidly couple the printhead assembly 108 to a source of cool dry gas. The gas can flow from the gas inlet through a gas conduit 235 toward the region 224 to be cooled. The lowermost point 226 of the gas conduit shown in FIG. 2C is in fluid communication with the region 224, shown in FIG. 7. The gas is forced in a substantially horizontal direction through the region 224 and across the die 220 and printhead 133. A vent can be included at the opposite end of the printhead assembly 108 from where the gas entered the region 224, to permit the gas to escape the housing of the printhead assembly 108 after traveling through the region 224. In another implementation, the gas can be redirected toward a gas outlet and recycled. The gas can be any suitable gas including air or pure nitrogen.

In another implementation, a warm or hot gas can be forced through region 224 to raise the temperature of the region 224 and therefore at the printhead.

In one implementation, the printhead assembly 108 can be formed using a high stiffness material, e.g., a glass-filled liquid crystal polymer. At least some components can be formed from a high tensile and yield strength material such as stainless steel, for example, the mounting plates 122*a-b*. The filter 200 can be a woven material, e.g. a woven stainless or plastic, such as nylon, Teflon, polyethylene or polypropylene.

The use of terminology such as "front" and "back" and "top" and "bottom" throughout the specification and claims is for illustrative purposes only, to distinguish between various components of the printhead module and other elements described herein. The use of "front" and "back" and "top" and "bottom" does not imply a particular orientation of the printhead module. Similarly the use of horizontal and vertical to describe elements throughout the specification is in relation to the implementation described. In other implementations, the same or similar elements can be orientated other than horizontally or vertically as the case may be.

A number of embodiments of the invention have been described. Nevertheless, it will be understood that various modifications may be made without departing from the spirit and scope of the invention.

What is claimed is:

1. A mounting assembly for a printhead assembly, comprising:

at least one mounting connector configured to connect the mounting assembly to the printhead assembly, where the printhead assembly has a length in a first direction and a width in a second direction and the length is greater than the width;

an active first direction mount comprising:

a top component, a bottom component and two side components substantially forming a parallelogram configuration, where the bottom component is fixed from movement and the top component is configured to move in the first direction while remaining substantially parallel to the bottom component and the two side components are configured to move in the first direction while remaining substantially parallel to one another;

a first drive mechanism configured to drive the top and two side components to move in the first direction; and a mounting structure that includes a plate to which the bottom component of the active first direction mount is affixed and that includes an aperture in the plate, the aperture positioned next to where the bottom component is affixed such that the aperture is aligned with a portion of the printhead assembly having nozzles, and the nozzles included in the printhead assembly are exposed to a substrate that can be positioned beneath the plate;

wherein, the at least one mounting connector moves in the first direction in response to movement in the first direction of the two side and top components of the active first direction mount, thereby providing movement in the first direction to the printhead assembly.

2. The mounting assembly of claim 1, further comprising:

at least a second mounting connector configured to connect the mounting assembly to the printhead assembly; and a passive mount configured to connect to the printhead assembly by the second mounting connector, the passive mount comprising:

a top component, a bottom component and two side components substantially forming a parallelogram configuration, where the bottom component is fixed from movement and the top component is configured to move in the first direction while remaining substantially parallel to the bottom component and the two side components are configured to move in the first direction while remaining substantially parallel to one another;

wherein, the passive mount moves in the first direction in response to movement in the first direction of the printhead assembly connected to the passive mount by the second mounting connector.

3. The mounting assembly of claim 1, wherein the active first direction mount further comprises:

a tongue protruding from the top component, wherein:

the first drive mechanism is configured to directly drive movement of the tongue and thereby the top component in the first direction;

in response to movement of the top component which is flexibly connected to the two side components, the two side components are indirectly driven to move in the first direction.

4. The mounting assembly of claim 3, the first drive mechanism further comprising:

a motor configured to rotate a drive shaft about a first axis orientated in a third direction substantially perpendicular to the first and second directions; and a bearing in contact with the tongue and configured to rotate with an upper portion of the drive shaft, wherein the upper portion of the drive shaft has a center, longitudinal axis orientated in the third direction but displaced in the first direction from the first axis, the bearing thereby rotating eccentrically about the first axis;

wherein as the bearing rotates eccentrically about the first axis, the tongue and thereby the top component are displaced in the first direction.

5. The mounting assembly of claim 1, further comprising:

an active second direction mount configured to connect to the printhead assembly by the at least one mounting connector, the active second direction mount comprising:

an upper structure including:

the at least one mounting connector to connect to a printhead assembly;

a second motor configured to rotate a drive shaft and an upper bearing about an axis of rotation;

where the upper structure is connected to the active first direction mount by one or more flexures;

a lower structure rigidly connected to the active first direction mount, the lower structure including:

a lower bearing connected to a lower portion of the drive shaft, wherein the lower portion of the drive shaft has a center, longitudinal axis orientated in the third direction but displaced in a perpendicular direction from the axis of rotation, the lower bearing thereby rotating eccentrically relative to rotation of the upper bearing;

wherein the relative eccentric rotation of the lower and upper bearings causes the upper structure to displace in the second direction as the lower and upper bearings rotate and thereby providing a pivot motion to the printhead assembly about an axis in a third direction.

6. The mounting assembly of claim 1, further comprising:

at least a second mounting connector configured to connect the mounting assembly to the printhead assembly;

a passive mount configured to connect to the printhead assembly by the second mounting connector, the passive mount comprising:

a top component, a bottom component and two side components substantially forming a parallelogram configuration, where the bottom component is fixed from movement and the top component is configured to move in the first direction while remaining substantially parallel to the bottom component and the two side components are configured to move in the first direction while remaining substantially parallel to one another;

wherein, the passive mount moves in the first direction in response to movement in the first direction of the printhead assembly connected to the passive mount by the second mounting connector; and an active second direction mount configured to connect to the printhead assembly by the at least one mounting connector, the active second direction mount comprising:

an upper structure including:

the at least one mounting connector to connect to a printhead assembly;

a second motor configured to rotate a drive shaft and an upper bearing about an axis of rotation;

where the upper structure is connected to the active first direction mount by one or more flexures;

a lower structure rigidly connected to the active first direction mount, the lower structure including:

a lower bearing connected to a lower portion of the drive shaft, wherein the lower portion of the drive shaft has a center, longitudinal axis orientated in the third direction but displaced in a perpendicular direction from the axis of rotation, the lower bearing thereby rotating eccentrically relative to rotation of the upper bearing;

wherein the relative eccentric rotation of the lower and upper bearings causes the upper structure to displace in the second direction as the lower and upper bearings rotate and thereby providing a pivot motion to the printhead assembly about an axis in a third direction.

7. A system for depositing a fluid onto a substrate, comprising:

a mounting assembly for a printhead assembly, comprising:

at least one mounting connector configured to connect the mounting assembly to the printhead assembly, where the printhead assembly has a length in a first direction and a width in a second direction and the length is greater than the width; and an active first direction mount comprising:

a top component, a bottom component and two side components substantially forming a parallelogram configuration, where the bottom component is fixed from movement and the top component is configured to move in the first direction while remaining substantially parallel to the bottom component and the two side components are configured to move in the first direction while remaining substantially parallel to one another;

a first drive mechanism configured to drive the top and two side components to move in the first direction;

wherein, the at least one mounting connector moves in the first direction in response to movement in the first direction of the two side and top components of the active first direction mount;

the printhead assembly comprising:

a housing configured to house a nozzle assembly and including a conduit configured to receive a printing fluid and provide the printing fluid to the nozzle assembly;

the nozzle assembly including a plurality of nozzles configured to receive the printing fluid and deposit the printing fluid onto a substrate;

at least one printhead mounting connector configured to mate with the at least one mounting connector included in the mounting assembly;

wherein movement in the first direction of the at least one mounting connector mated to the at least one printhead mounting connector provides movement to the printhead assembly in the first direction; and a mounting structure that includes a plate to which the bottom component of the active first direction mount is affixed and that includes an aperture in the plate, the aperture positioned next to where the bottom component is affixed such that the aperture is aligned with the nozzle assembly of the printhead assembly, and the plurality of nozzles included in the nozzle assembly are exposed to the substrate that can be positioned beneath the plate.

8. The system of claim 7, wherein the mounting assembly further comprises:

at least a second mounting connector configured to connect the mounting assembly to the printhead assembly; and a passive mount configured to connect to the printhead assembly by the second mounting connector, the passive mount comprising:

a top component, a bottom component and two side components substantially forming a parallelogram configuration, where the bottom component is fixed from movement and the top component is configured to move in the first direction while remaining substantially parallel to the bottom component and the two side components are configured to move in the first direction while remaining substantially parallel to one another;

wherein, the passive mount moves in the first direction in response to movement in the first direction of the printhead assembly connected to the passive mount by the second mounting connector.

9. The system of claim 7, wherein the active first direction mount of the mounting assembly further comprises:

a tongue protruding from the top component, wherein:

the first drive mechanism is configured to directly drive movement of the tongue and thereby the top component in the first direction;

in response to movement of the top component which is flexibly connected to the two side components, the two side components are indirectly driven to move in the first direction.

10. The system of claim 9, wherein the first drive mechanism of the active first direction mount of the mounting assembly comprises:

a motor configured to rotate a drive shaft about a first axis orientated in a third direction substantially perpendicular to the first and second directions; and a bearing in contact with the tongue and configured to rotate with an upper portion of the drive shaft, wherein the upper portion of the drive shaft has a center, longitudinal axis orientated in the third direction but displaced in the first direction from the first axis, the bearing thereby rotating eccentrically about the first axis;

wherein as the bearing rotates eccentrically about the first axis, the tongue and thereby the top component are displaced in the first direction.

11. The system of claim 7, wherein the mounting assembly further comprises:

an active second direction mount configured to connect to the printhead assembly by the at least one mounting connector, the active second direction mount comprising:

an upper structure including:

the at least one mounting connector to connect to a printhead assembly;

a second motor configured to rotate a drive shaft and an upper bearing about an axis of rotation;

where the upper structure is connected to the active first direction mount by one or more flexures;

a lower structure rigidly connected to the active first direction mount, the lower structure including:

a lower bearing connected to a lower portion of the drive shaft, wherein the lower portion of the drive shaft has a center, longitudinal axis orientated in the third direction but displaced in a perpendicular direction from the axis of rotation, the lower bearing thereby rotating eccentrically relative to rotation of the upper bearing;

wherein the relative eccentric rotation of the lower and upper bearings causes the upper structure to displace in the second direction as the lower and upper bearings rotate and thereby providing a pivot motion to the printhead assembly about an axis in a third direction.

12. The system of claim 7, further comprising:

at least a second mounting connector configured to connect the mounting assembly to the printhead assembly;

a passive mount configured to connect to the printhead assembly by the second mounting connector, the passive mount comprising:

a top component, a bottom component and two side components substantially forming a parallelogram configuration, where the bottom component is fixed from movement and the top component is configured to move in the first direction while remaining substantially parallel to the bottom component and the two side components are configured to move in the first direction while remaining substantially parallel to one another;

wherein, the passive mount moves in the first direction in response to movement in the first direction of the printhead assembly connected to the passive mount by the second mounting connector; and an active second direction mount configured to connect to the printhead assembly by the at least one mounting connector, the active second direction mount comprising:

an upper structure including:

the at least one mounting connector to connect to a printhead assembly;

a second motor configured to rotate a drive shaft and an upper bearing about an axis of rotation;

where the upper structure is connected to the active first direction mount by one or more flexures;

a lower structure rigidly connected to the active first direction mount, the lower structure including:

a lower bearing connected to a lower portion of the drive shaft, wherein the lower portion of the drive shaft has a center, longitudinal axis orientated in the third direction but displaced in a perpendicular direction from the axis of rotation, the lower bearing thereby rotating eccentrically relative to rotation of the upper bearing;

wherein the relative eccentric rotation of the lower and upper bearings causes the upper structure to displace in the second direction as the lower and upper bearings rotate and thereby providing a pivot motion to the printhead assembly about an axis in a third direction.

13. The system of claim 12, wherein:

the least one printhead mounting connector configured to mate with the at least one mounting connector included in the mounting assembly comprises a mounting plate attached to the housing and including a first portion extending from a first side of the housing and a second portion extending from a second side of the housing;

the at least one mounting connector included in the mounting assembly comprises:

a first slot included in the active second direction mount configured to receive the first extended portion of the mounting plate;

a first channel included in the active second direction mount;

one or more first elements adjacent the first channel;

a first mounting plate clamp screw slidably received in the first channel such that the one or more first elements are urged against the first extended portion of the mounting plate when the first mounting plate clamp screw is screwed into the first channel; and the at least second mounting connector included in the mounting assembly comprises:

a second slot included in the passive mount configured to receive the second extended portion of the mounting plate;

a second channel included in the passive mount;

one or more second elements adjacent the second channel;

a second mounting plate clamp screw slidably received in the second channel such that the one or more second elements are urged against the second extended portion of the mounting plate when the second mounting plate clamp screw is screwed into the second channel.

14. The system of claim 13, wherein the first mounting plate clamp screw comprises a first cammed surface to urge the one or more first elements and the second mounting plate clamp screw comprises a second cammed surface to urge the one or more second elements.

15. The system of claim 14, wherein the one or more first elements comprise one or more first balls and the one or more second elements comprise one or more second balls.

16. The system of claim 7, wherein the printhead assembly further comprises:

a gas conduit configured to receive a gas at a temperature lower than a temperature of the fluid within the nozzle assembly and to provide the gas to a region near the nozzle assembly.

17. The system of claim 16, wherein the gas is substantially dry air.

18. The system of claim 16, wherein the housing of the printhead assembly further comprises a gas outlet configured to expel the gas after passing through the region near the nozzle assembly.

19. The system of claim 7, wherein the nozzle assembly of the printhead assembly further comprises:

a plurality of fluid inlets; and a plurality of pumping chambers;

wherein each fluid inlet is fluidly coupled to a pumping chamber which is fluidly coupled to a nozzle and in response to a control signal activating an actuator adjacent the pumping chamber, printing fluid is urged from the pumping chamber through the nozzle and onto the substrate.

20. The system of claim 19, wherein the printhead assembly further comprises:

a circuit system configured to receive input signals and based on the received input signals provide control signals to the nozzle assembly to selectively fire the plurality of nozzles.

21. The system of claim 20, wherein the actuator comprises a piezoelectric deflector configured to flex in response to the control signal, the flex displacing printing fluid included in the pumping chamber.

* * * * *